US011606635B2

(12) United States Patent
Zhu

(10) Patent No.: US 11,606,635 B2
(45) Date of Patent: Mar. 14, 2023

(54) NOISE REDUCTION AIR TUBE MICROPHONE, NOISE-REDUCTION SAFE HEADSET AND NOISE-REDUCTION SAFE BLUETOOTH HEADSET

(71) Applicant: Aidao Zhu, Zhejiang (CN)

(72) Inventor: Aidao Zhu, Zhejiang (CN)

( * ) Notice: Subject to any disclaimer, the term of this patent is extended or adjusted under 35 U.S.C. 154(b) by 227 days.

(21) Appl. No.: 16/753,795

(22) PCT Filed: Oct. 8, 2018

(86) PCT No.: PCT/CN2018/000348

§ 371 (c)(1),
(2) Date: Apr. 5, 2020

(87) PCT Pub. No.: WO2019/068238

PCT Pub. Date: Apr. 11, 2019

(65) Prior Publication Data

US 2020/0252708 A1 Aug. 6, 2020

(30) Foreign Application Priority Data

Oct. 5, 2017 (CN) ..... 201710956548.7

(51) Int. Cl.
*H04R 1/08* (2006.01)
*H04R 1/10* (2006.01)
*H04R 5/033* (2006.01)

(52) U.S. Cl.
CPC ..... *H04R 1/08* (2013.01); *H04R 1/1083* (2013.01); *H04R 5/033* (2013.01); *H04R 2420/07* (2013.01)

(58) Field of Classification Search
None
See application file for complete search history.

(56) References Cited

U.S. PATENT DOCUMENTS 3,633,705 A * 1/1972 Teder ..... H04M 1/05 181/158
2013/0156247 A1* 6/2013 Boyajian ..... H04R 1/30 381/370

FOREIGN PATENT DOCUMENTS

CN 202353778 U 7/2012
CN 102905205 A 1/2013
CN 203504720 U 3/2014
CN 203563171 U 4/2014
(Continued)

*Primary Examiner* — Kenny H Truong
(74) *Attorney, Agent, or Firm* — Tianhua Gu; Global IP Services

(57) ABSTRACT

A noise-reduction microphone, a noise-reduction safe earphone and a noise-reduction safe Bluetooth headset, comprising an acoustic wave concentrator which has a sound signal capturing unit at its big end used to capture sound wave signal and amplify the external sound wave signal, and then transmitted to the small end of the acoustic wave concentrator connected to the air tube, and the air tube is connected to the receiver device which receives the acoustic signal from the air tube and converts it into electrical sound signals transmitted to a voice terminal from the receiver device by a connector. The sound information is transmitted by the air tube, so the length of the air to be could be setted pretty long so that people can keep at a distance from electrical equipments with radiation, the remote air tube microphone can be separately used as microphone or mike.

3 Claims, 34 Drawing Sheets

(56) References Cited

FOREIGN PATENT DOCUMENTS

| | | | |
|---|---|---|---|
| CN | 204425632 | U | 6/2015 |
| CN | 206272819 | U | 6/2017 |
| CN | 107071607 | A | 8/2017 |

* cited by examiner

E-E

F Direction

NOISE REDUCTION AIR TUBE MICROPHONE, NOISE-REDUCTION SAFE HEADSET AND NOISE-REDUCTION SAFE BLUETOOTH HEADSET

CROSS REFERENCE TO RELATED PATENT APPLICATION

The present application is the US national stage of PCT/CN2018/000348 filed on Oct. 8, 2018, which claims the priority of the CN No. 201710956548.7 filed on Oct. 5, 2017, which application is incorporated herein by reference.

FILED OF THE INVENTION

The present invention relates to an air tube microphone, a noise-reduction earphone and a Bluetooth earphone.

BACKGROUND OF THE INVENTION

An ordinary earphone, such as the one along with in a mobile phone or other communication devices, includes a plug, a conductive wire and earphone head, with the earphone having micro-speaker s installed therein. Since people directly use the phone to listen and talk, the super high frequency magnetic field or other harmful radiation caused by the mobile phone will severely stimulate brain nerves of people, hurting people's health. Usually, people use earphone device to answer a call in order to reduce the harm caused by many kinds of radiation rays such as super high frequency magnetic field, and electric wave and thermal energy. However, using the common earphone with a speaker directly mounted in the earphone heads is still unable to avoid the danger from transmitting the radiation rays such as the super high-frequency magnetic field to the ears and up into the brain. In addition, such earphone heads with speakers mounted therein have the permanent magnetic field up to 1600G; which also have drastic harm to people's brain. So, using frequently such mobile phone or the earphones for a long time can easily cause symptoms of headache, dizziness, numbness, etc.

An existing radiation-proof earphone for instance, a product called as "radiation-free earphone" with patent number ZL02244828.4 can reduce electromagnetic radiation, however, its sound wave channel is only 5-10 cm and does not have metal shielded wire, which cannot reach the requirement of 2 mG or less. The purpose of being controlled as 2 mG or less is provided according to the theory of the inventor of the cell phone, Professor Shi Min of Taiwan Communication University, PhD of Stanford University in US, academician of American Academy of Engineering due to the harm to human by magnetic field and electromagnetic wave. So the existing earphone cannot meet the requirement of anti-electromagnetic radiation as mentioned above. Thus frequency response is not good; the application No. 200810167226.5, entitled "Safe Earphone Device", applied by the present inventor, discloses five inventions of a safe earphone device and methods of achieving radiation-free and improving the sound quality which is granted patents from nine countries. But sound quality of the safe earphone this patent is not better than the ordinary earphones.

The microphone of existing earphones has two types of setting as below: the first one is that the wire of earphones commonly used in mobile phones has a resonant microphone, or the body of Bluetooth earphones has a resonant microphone therein, the microphone is at a certain distance from the mouth of the user, therefore the microphone's radio sensitivity needs to be set high in order to receive the user's voice clearly, but this design will also clearly receive various noises of the environment in which the user speaks; the second one is that stereo over-head binaural headphones, such as call headsets used by customer service personnel, is connected to the microphone through a metal wire, and the microphone is set near the user's mouth, which has a large radiation.

There are also other devices with remote noise-reduction microphone, such as landline telephones, mobile phones, laptops etc which have the above problems that is loud noise or large radiation.

Therefore, people extraordinarily need a noise-reduction microphone which can prevent electromagnetic radiation and have a better noise-reduction effect than traditional noise-reduction microphone, and an earphone with no radiation and low noise.

SUMMARY OF THE INVENTION

The purpose of the present invention is to overcome the shortcomings and defects of the existing technology, and provide a remote noise-reduction microphone, noise-reduction headset and Bluetooth headset, which mainly includes an air tube microphone, a wired noise-reduction headset and an over-ear noise-reduction headphone, etc; having plurality of speakers with different frequency responses respectively used for two ears to listen, so the frequency response is particularly good and better than the ordinary earphones; and setting up a noise reduction special solution, more importantly, it is provided with a noise reduction signal conversion system effectively which effectively converts the transmission of the active noise reduction frequency signal into the transmission of the passive audio signal and then restore to the transmission of the active audio signal, which can make the passive audio transmission of the air tube be 1000 mm in length. Human body is isolated from radiation of communication at a long distance because of setting a metal shielded wire while a microphone is still kept at a close distance, which achieves a good noise reduction effect and a high degree of radiation protection as well as high sound quality, moreover, solving the technical problem that the microphone of the existing radiation-proof earphone must be placed outside the air tube. Because if the microphone is put too far away, the function of the microphone will be affected and its sound volume will be low.

The present invention is a good noise-reduction earphone with highly anti-radiation ability and highly anti-noise sound quality.

A noise-reduction air tube microphone, includes an acoustic wave concentrator having a sound signal capture unit at its big end used to capture sound wave signal and amplify the external sound wave signal in a wave or electric signal form, and then transit the acoustic wave to the small end of the acoustic wave concentrator connected to an air tube, and the other end of the air tube is connected to a receiver device which receives acoustic signals from the air tube and converts it into electrical sound signals transited to a voice terminal from the receiver device by a connector. The sound information is transmitted by the air tube and converted into electrical signals by the receiver device and then transited to the voice terminal by the connector, the length of the air tube could be set pretty long so that people can keep at a distance from electrical equipment with radiation.

The air tube microphone can be separately used as microphone or mike connected to communication devices such as mobile phones, landlines, etc, the devices such as computers, notebooks that can communicate through network, as well as the devices that can record sound for collecting sound, call and recording, etc, it is can also be used as a part of the earphone to collect voice information.

The sound signal capturing unit is a diaphragm. The external acoustic wave reaches the diaphragm, and the diaphragm vibrates and amplifies the acoustic wave, and then transit through the air tube.

A cover with several through-holes is arranged on the outside of the diaphragm which is fasten at the big end of the acoustic wave concentrator by the cover.

The sound signal capturing unit includes a first microphone, an amplifier and a speaker, the sound outlet of the speaker is connected to the big end of the acoustic wave concentrator, the small end of which is connected to the air tube when the other end is connected to the receiver, the receiver receives the acoustic signal of the air tube and then converts it into a sound electrical signal, the receiver transmits the sound electrical signal to voice terminal through the connector. The sound signal capturing unit constitutes a noise reduction converter.

The noise-reduction converter as mentioned above, wherein the receiver includes a taper-shaped sound amplifier of which the small end is connected to the air tube and the big end is connected to the microphone, the output of the microphone is connected to a amplifier of which the output is connected to the metal shielded wire, and connected to the voice terminal through the connector after then. The microphone is also called mike.

An air tube microphone Bluetooth earphone as mentioned above, wherein the Bluetooth earphone is provided with an audio input jack forming a signal connection with the connector or the connector with adapter. The connector of the noise-reduction microphone of the present patent equipped with an adapter or set as a jack adapted to the Bluetooth earphone can be used as an anti-radiation Bluetooth earphone.

A noise-reduction earphone, includes an earphone head, provided therein with a sound cavity which has a first end having a sound outlet;

a main body, provided therein with an acoustic wave concentrator with a channel opening is connected to a second end of the sound cavity through a sound wave transmission channel;

a micro-speaker, wherein the acoustic wave concentrator is between the micro-speaker and the sound wave transmission channel;

the micro-speaker is connected with a first end of a conductor outside the main body and a second end of the conductor is connected with a plug;

a microphone is set as a conversion system converting an active audio signal into a passive transmission signal and restoring to the active audio signal again.

The noise-reduction earphone as mentioned above, wherein 1) the noise-reduction safe over ear headphone is provided with a left ear cup (195), a sound chamber casing (195-3), a left ear casing (195-1), a right ear cup (194), a right ear casing (195-2), a headband (185), a switch and its switch housing (191), a noise reduction transmission arm (198), and a noise-reduction converter (196), a housing (195-1), a speaker housing (190), a plug (193), and is provided with a noise-reduction conversion system: converting the transmission from the active audio signal into the passive audio signal, setting the first microphone wired to the circuit of an audio amplifier (As FIG. 32) to push the speaker, the circuit is decided by the length and diameter of the selected air tube, the big end of the acoustic wave concentrator is connected to the sound outlets of the speaker and the small end is riveted to the one end of microphone air tubes of which the other end is connected to the small end of the sound cavity of taper shape, the big end of the sound cavity is connected to the a sound receiving face of a second microphone, the connection from the sound outlets of the speaker through the air tube to the sound receiving face of the second microphone is sealed; the other end of the second microphone is wired to the one end of a metal shielded wire of which and the other end is connected to the one end of the plug, the other end of which is connected to the socket of communication device;

the active part of the conversion system is provided with an electronic circuit board, a battery to supply power circuit and its elements, a charging circuit and a charging socket connected to the battery, a power LED and a power switch, and the active signal elements of the aforesaid conversion system are all mounted in the converter, the speaker of the conversion system is mounted in the middle of the first microphone, or the outboard of the sound cavity inside the left ear housing, (as FIG. 32). The circuit can change the amplification power of the circuit according to the length of the microphone air tube to select different chips and different circuits.

The signal transmission of the microphone is converted from active transmission into passive transmission then restore to active transmission again, which allows setting the air tube very long, and the microphone keeps at a very close distance to the sound outlet to achieve noise reduction and meanwhile super-highly protect the ear and brain from the harm of communication devices.

The one end of the left ear air tube (187-1) is connected to the inlet of the sound cavity producing the sound (209-1), and the other end is connected to the small end of the acoustic wave concentrator (205) of which the big end of wherein the acoustic wave concentrator is connected to the speaker (207), the other end of which is wired to the metal shielded wire (192); the one end of the air tube of right ear (188-1) is connected to the entry of the right sound cavity producing the sound when the other end of the air tube of right ear passes through the left ear casing (195-1) along the outboard of the metal headband (186), with the air tube (187-1) of left ear parallel to the speaker casing (190) and is connected to the small end of the right ear acoustic wave concentrator (206), the other end of which is connected to the one end of a right ear speaker (208), the other end of the right ear speaker (208) is wired to the one end of metal shielded wire (192) through the switch (191), the other end of wherein the metal shielded wire (192) is connected to the plug (193), or mounting both of the left and right ear speakers, the left and right ear acoustic wave concentrators and the second microphone in the switch casing in the same connection way, the outlet of the sound cavity producing the sound is provided with one small hole or several holes, the convection hole of the aforesaid speaker exhaust airflow to the outside of its casing, the microphone is isolated from the speaker;

The three air tubes are parallelly bonded sides by sides (FIG. 33-1), or all bonded together and its cross-section is a triangle shape (FIG. 33-4), or all bonded together covered by flexible material outside and its cross-section is of triangle shape; or all bonded together as above without covering by flexible material outside and its cross-section is of triangle shape;

or setting the right air tube obliquely pulled from the speaker casing to the inlet of the right ear sound cavity, that is not passing along a metal headband.

Or aforesaid three air tubes are pulled out of the case of the speaker of the telecommunications machine used for transmitting audio signal, or all of air tubes are pulled out of the E side as FIG. 29 and are connected to the inside of the left ear casing;

the joint surface and the other exposed seams should be sealed with glue and waterproof when assembled.

(2) A diaphragm (262) is mounted at the big end of the acoustic wave concentrator (263), and a cover (261) with several holes is arranged on the outside of the diaphragm (262), and then the diaphragm (262) is tightly fasten at the big end of the acoustic wave concentrator (263) of which the small end is connected to the one end of the air tube (264), the other end of the air tube is connected to the small taper-shaped end (sound amplifier) of which the big end is connected to the microphone, the joint of the sound receiving face of the microphone (266) to the cover (261) is sealed;

the conductor (267) of the small microphone is connected to the amplifier (268) of which the output terminal is connected to the metal shielded wire (269) and then connected to the communication devices by the connector;

the length of the air tube (264) is between 30 mm and 1500 mm, the diameter of the hole is between 1 mm and 5 mm, the length and diameter of the hole is upon the real requirement;

The present device can install the microphones of all safe earphones into the horn (265) instead of the small microphone (266) which is placed outside the length of the air tube in current technology. Or the megaphone is composed of a cover (261), a diaphragm (262), an acoustic wave concentrator (265) and an air tube, the megaphone can connect microphones which is located far from the mouth to the mouth by using different-sized taper-shape cavity to achieve the purpose of noise reduction and radiation prevention.

(3) A binaural over-ear noise-reduction air tube headphone with mono channel is provided with a plug (290-1) receiving the signal from the communication devices is connected to the one end of the big speaker (284) by a metal shielded wire (287), the other end of the speaker (284) is connected to the big end of the acoustic wave concentrator (284-1) of which the small end is connected to a big tube (288) of the combined air tube (283), the other end of the big tube (288) is connected to the long end of the tee (290) and is tightly fasten with a cable (300), and the other end of the tee (290) is connected to the one end of a sealing ring (295) of which the other end is connected to a branch air tube of right ear (294), the other end of which is connected to a sealing ring (292), the other end of the sealing ring (292) is connected to an elbow (291) of which the other end is connected to a sound cavity (291-1), the bottom of the elbow is provided with a mounting plate (274-1) fixed in the right ear casing (274) with four screws (293), a positioning pin is arranged inside the right ear casing to position the elbow, the outlet of the sound cavity is provided with a cover plate with several pierced holes;

the top side of the tee (290) is provided with a small pipe (302) having the small acoustic wave concentrator (302-1) at one end connected to the tee (290), the other end of the small pipe (302) is connected to a small sou40 cavity (302-1) having a cover plate (301-1) provided with several holes;

the structure is provided with a movable slot (270) to enable the bow (273) and the branch air tube (272) to move at a set swing angle, the sealing ring (295) is arranged at the axis of the swing and is made of flexible material like rubber etc to let the movement of the bow (273) and the air tube of right ear (272) flexible and the transmission of acoustic wave unobstructed;

the inner diameter of the small pipe (302) is much smaller than the inner diameter of the tee (290), the specific size is calculated and determined by the attenuation value of the branch air tube of right ear to let the sound volume of right and left ear keep the same;

the bottom of the tee (290) is provided with a mounting plate (297) with small holes, which is mounted at the left ear casing (276) by the screw (290-1) and has a positioning pin to accurately position the tee at the bottom of the left ear casing (276). The joint from the sound outlet of the big speaker (284) to the cover plate of the sound cavity of right ear and the cover plate of the sound cavity of left ear are all sealed, so that the acoustic waves would not be leaked, and the sounds played from the big speaker (284) are all sent to the left and right ears for listening.

an audio amplifier circuit can be set in the font of the big speaker if the volume is too low, the amplifier circuit is installed in the big speaker housing (286-A), and the value of the amplification power of the amplifier circuit is selected by the requirements;

set up a holonomic noise-reduction receiver conversion system: the first noise-reduction microphone drives the speaker (278) by the amplifier (282-A), the sound outlet of the speaker (278) is connected to the big end of the acoustic wave concentrator (278-B) of which the small end is connected to the small air tube (277-A), the small air tube (277-A) passes from the noise-reduction universal transmission arm (277) into the left ear casing (276) and then is connected to the hard connector (275) of which the other end is inserted into the one end of the small tube (289) of the combined air tube (283), the other end of the small tube (289) is connected to the curved hard tube (275-A) passing through the separator (285) and connected to the small end of the small acoustic wave concentrator (271) by a soft tube, the big end of the small acoustic wave concentrator (271) is connected to the sound receiving face of the second receiver (275-B) of which the conductor is connected to the answer line of the metal shielded wire (287) through the control of the switch (286) which can connect and disconnect the telephone receiving system to make people hear or cannot hear the user's speech, and then it is connected to the communication device by the connector (290), the battery of the converter is arranged in the converter housing (278-A) having the indicator light (281) which indicated the power on/off, the translucent body of the indicator light (281) is molded on the converter housing (278-A) provided with the switch (297-A) to control the power on/off, the switch (297-A) is sealed by a rubber mat, a waterproof charging socket (282) is provided to charge the battery, a plug-in separator (278-C) and a slot plate (278-D) are arranged among the speaker (278), the amplifier circuit and the first microphone (280), a flexible material is placed inside the slot plate (278-D), the wire of the speaker passes through the separator and is sealed with glue, the converter housing (278-A) is fixed to the universal arm (277) with the screw (277-A) or by injection molding, the combined air tube is provided with one big tube and one small tube, which seems just one tube in appearance, not only beautiful but light;

The shell (286-A) is provided therein with a separator to separate the big speaker (284) and the second receiver (275-B), so as to prevent the big speaker (284) from interfering with the second receiver (275-B).

The noise-reduction microphone of the binaural over-ear noise-reduction air tube headphone with mono channel is a device converting an active audio signal into a passive transmission signal and restoring to the active audio signal again according to the third point of claim 25.

The transmission way of the noise-reduction microphone is different from above, and the remaining structure is the same as that of the noise-reduction earphone in third point of above claim.

The noise-reduction air tube microphone in the present Embodiment, as the structure of FIG. 34, a housing (278-C) is mounted at the end of the universal transmission arm (277-1), and the housing (278-C) is provided therein a megaphone (262-1) which includes the cover (261), the diaphragm (262), the acoustic wave concentrator (263), and the air tube (264), the small air tube (264) passes from the noise-reduction universal transmission arm (277-1) into the left ear casing (276-1) and then is connected to the hard connector (275-1) of which the other end is inserted into the one end of the small tube (289-1) of the combined air tube (283-1), the other end of the small tube (289-1) is connected to the curved hard tube (275-C) passing through the separator (285-1) and connected to the small taper-shape end (271-1) of the small microphone (275-D) by a soft tube, the big end of the small taper-shape end (271-1) is connected to the sound receiving face of the small microphone (275-D) of which the conductor is connected to the answer line of the metal shielded wire (287-1) through the control of the switch (286-1) which can connect and disconnect the telephone receiving system to make people hear or cannot hear the user's speech, and then it is connected to the communication device by the connector (290-1), and in this way, the passive audio signal is directly generated by the small microphone without conversion, the housing (278-C) near the above cover (261) has several holes, or the acoustic wave concentrator (263) is directly mounted on the housing (278-C) having several holes and fastens the diaphragm (262), the circuits with joint all sealed are simpler and more cost-effective;

The shell (286-C) is provided therein with a separator (285-1) to separate the big speaker (284-1) and the small microphone (275-D), the conductor is glued after passing from the separator (285-1), so as to prevent the big speaker (284) from interfering with the second receiver (275-B).

An audio amplifier circuit can be arranged at the output terminal of the small microphone to amplified output audio signal if it is enough, the circuit shares the same electric power with the circuit of the big speaker or are installed at one circuit board, the power is supplied from the battery mounted on the housing or the battery line of the communication device;

The advantage of this structure is that all batteries keeps away from brain and ear, which achieves the great anti-radiation effects.

The noise-reduction earphone as mentioned above,

A noise-reduction aviation over-ear headphone is provided with the structure including a stitched steel head bow, the head bow and an adjustable bracket fixed together by screws, the adjustable bracket and a fixing bracket are fixed together by self-locking nuts, the fixing bracket is connected to a left ear casing through lock pillars, the right ear casing is connected and fixed in the symmetric and same way as the left ear casing.

The noise-reduction microphone is mounted in the megaphone housing connected to a universal hose with a variable gear, the left ear and right ear sound cavity is disposed in the ear casing, the air tube of the right sound cavity passes through the left ear casing and is connected to the sound cavity inside the right ear casing along a steel bow, or is obliquely pulled from the speaker casing to the the right ear casing and then to the sound cavity therein, or the left and right sound cavity are separately connected to an air tube.

The noise-reduction conversion system and the rest of the structure and connection ways are the same as the binaural air tube noise-reduction earphone with air tube microphone in point 4

Separately provides with three speakers with different frequency response, three sound wave transmission channels with different response, sound chambers connected to the channels and wires of sound wave transmission channels for one ear or two ear, the two earphones are separately provided with the moving iron speaker and the moving coil speaker, each of them is separately disposed in big end of the acoustic wave concentrator, the acoustic wave concentrator is separately configured to the one end of the air tube of which the parallel end is separately connected to the sound cavity inside the earplug and the sound cavity inside the earplug, adding one more pair of speakers, air tubes and sound chambers while setting the speaker with three different frequency response based on above structure, the structure and connection manner are the same as above.

Binaural model is the noise-reduction earphone with super high sound quality.

Noise-reduction earphone is provided with several speakers with different frequency response for one ear or two ears having high sound quality.

The noise-reduction earphone as mentioned above, is a high sound quality noise-reduction earphone provided with frequency division circuit;

The first type of circuit with each one high frequency and one low frequency speaker:

the noise-reduction headphones with high and low frequency speakers in the above claims are provided with a frequency dividing circuit for the audio signal input pathway of the two speaker s, respectively, and a capacitance C1 is added to the high frequency speaker (305), and the capacity is 2.2 uF;

the inductance L1 is connected in series from the loop of the audio signal input of the low frequency speaker (306), and the inductance value is 0.57 mH.

the crossover point of the high and low frequency is set as 4500 HZ;

(2) the second type of circuit with each one high frequency and one low frequency speaker:

the input terminal of the high frequency speaker (309) is connected in series with a capacitor C1 with a capacitance of 1.1 uF and in parallel with an inductor L1 with an inductance of 1.31 mH, The output terminal of the low frequency speaker (308) is connected in series with an inductor L2 and in parallel with a capacitor C2 with a capacitance of 1.1 uF;

(3) the third type of circuit with one high frequency, one medium frequency and one low frequency speaker:

The input terminal of a high frequency speaker (309) is in series with a capacitor having a capacity of 1 uF, and the circuit is in parallel with an inductor L1 with an inductance of 1.31 mH, the input terminal of a two divided-frequency medium speaker (310) is connected in series with a capacitor C1 with a capacitance of 11.06 uF and an inductor with a capacity of 1.02 mH in the back, connect an inductor L2 with a capacity of 11.32 mH to the one end of the speaker between the capacitor C2 and the inductor L3, connect a capacitor C3 in parallel at both ends of the speaker, the input terminal of three divided-frequency (311) is connected in series with an inductor L4 with a capacity of 11.32 mH and a capacitor C4 in parallel with a capacity of 11.06 uF;

the crossover point of the low frequency is set as 450 HZ; the high frequency is set as 5000 HZ;

The above capacitance and inductance values are calculated in theory, the frequency response curve of each speaker terminal output through the air tube and then through the sound cavity should be tested at the connection point, and the capacity of the capacitance or the capacity of the inductance should be adjusted appropriately according to the test results of the frequency response until the frequency division reaches the correct and good result, In this way, each speaker is set to complete the sound of different frequencies, and the input audio signal can be sent out from each speaker perfectly to achieve a good frequency response, and there will be no phase error between the speakers to cause distortion. "+−" In the figure indicates the connection of the phases.

The two ends of the air tube separately connected to the acoustic wave concentrator or the sound cavity are all fixed with hollow rivet or glue or by other ways, the air tube could be straight, partly spiral, all spiral, or middle spiral and two ends straight, or a bend which can be hooked to the ears, the end point of the bend is provided with the earplug having a sound cavity.

Set part of the conductor to be straight or all of it to be spiral, or one section to be straight and one section to be spiral, or one section to be spiral and its two ends to be straight. Or set the air tube to be a bend which can be hooked to the ears, and put the earplug into the ear for listening after then.

Select the appropriate position in the side or the back of the sound cavity to open micro holes for air convection. The size of the small micro holes affects the sound volume.

The noise-reduction safe headphone as mentioned above, an air tube connection head is arranged at the joint between the headphone head and the air tube, the structure is as following:

(1) the connection head (14C) is provided with two left and right inverted buckles, the one end of an air tube covered with metal sleeve is inserted and riveted by a hollow rivet in the connection head (14C), another connection head (14C1) having the same structure is also placed at the other end of the air tube, so that the air tube can be actively connected to the acoustic wave concentrator inside the speaker housing, as FIG. 62, FIG. 63 show, the active connection head at two ends of the air tube is symmetrical and interchangeable;

the earplug with such connection structure can be made into several styles, for example, made into a large size, a medium size, a small size, or made into each one of in-ear style and ear hook style, or other different styles with different color which is interchangeable, so that users can choose different colors of the air tube according to their preferences, if there are two tubes, it can also set two holes in earplug tube and equip with two tubes of active connection head, and the connection hole is arranged on the speaker housing correspondingly;

(2) the active head (AA) of the spiral air tube, the one end is set as external thread of which the inner diameter of the inner hole is the inner diameter of the air tube, the diameter of the inner hole of the other end of the active head is set as the same as the outer diameter of the air tube, the air tube is glued when inserted into the hole, the outer diameter of the active head is the same as the overall dimension of (21C) connecting the earplug head and the air tube, the screw hole in the inner hole of the joint of earplug can be screwed down and interchanged with the external thread of the active head, the earplug can be made into several styles, the air tube can also be made into several styles, the other end of the air tube is connected to another active head (BB) having the same structure as the active head (AA), an air tube is inserted and glued in the active head, the screw thread and the screw hole on the speaker hosing is matching and interchangeable, puts a decorative ring at the joint between the active head (AA) and the earplug tube, puts a decorative ring at the joint between the active head (BB) and the speaker, the screw threads of the active head (AA) and the active head (BB) are the same, which are interchangeable with the screw hole of the earplug and the speaker;

for the earphone with two air tubes, more screw holes can be provided on the speaker housing or earplug to adapt and interchange various active heads or interchange air tube, and air tubes or earplugs with different colors or structure can be provided, which gives users more options.

The noise-reduction earphone as above,

The beneficial effect of the present invention is as below: the air tube microphone converts the transmission of audio signal to acoustic signal by the acoustic wave concentrator and air tube, the passive signal is transmitted by the air tube and then is converted into electric signals by the devices like microphone, in which way that the microphone keeps at a distance from users and then achieve noise reduction and radiation protection effects.

BRIEF DESCRIPTION OF THE DRAWINGS

To more clearly explain the technical schemes in the embodiments of this disclosure or in the current technologies, a simple explanation of the accompanying drawings required to describe the embodiments or current technologies is given below. The accompanying drawings in the following description are merely some embodiments recorded in this disclosure. For a person having ordinary skill in the art, without spending creative labor, it is possible to obtain other accompanying drawings based on these accompanying drawings.

FIG. 27-1 is a structure diagram of two air tubes passing through the casing;

FIG. 27-2 is a schematic view of a two-tube integrated air tube shaped of noodle;

FIG. 32-1 is an enlarged view of the signal audio with a relatively high power;

FIG. 33-1 is a schematic view of three air tubes parallelly bonded sides by sides;

FIG. 33-2 is a schematic view of the connection between the sound wave channel of the speaker and the sound cavity;

FIG. 33-3 is a schematic view of another kind of sound cavity;

FIG. 33-4 is a schematic view of three air tubes bonded together, having its cross-section shaped of triangle;

FIG. 53-1 is a schematic view of the structure of the switch, having the micro-switch away from the switch button;

DETAIL DESCRIPTION OF THE PREFERRED EMBODIMENTS

Embodiment 1

Figure 1:
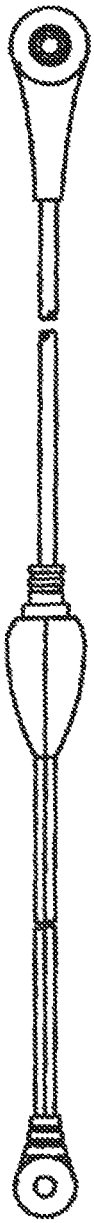
FIG. 1 is a right schematic view of the safe earphone according to the present invention, having two speaker placed vertically and acoustic wave concentrator.
Figure 2:
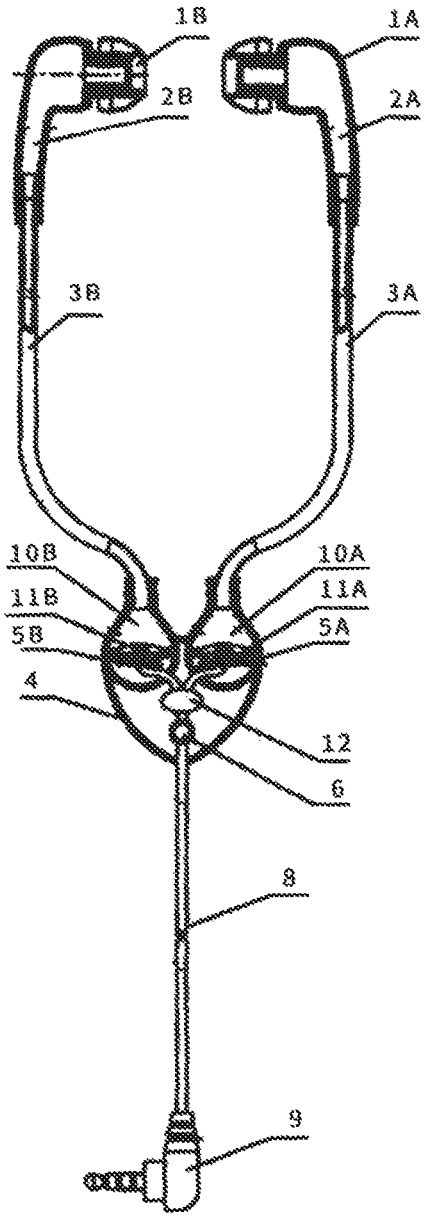
FIG. 2 is a main schematic view of the safe earphone according to the present invention, having two speaker placed vertically and acoustic wave concentrator.
Figure 3:
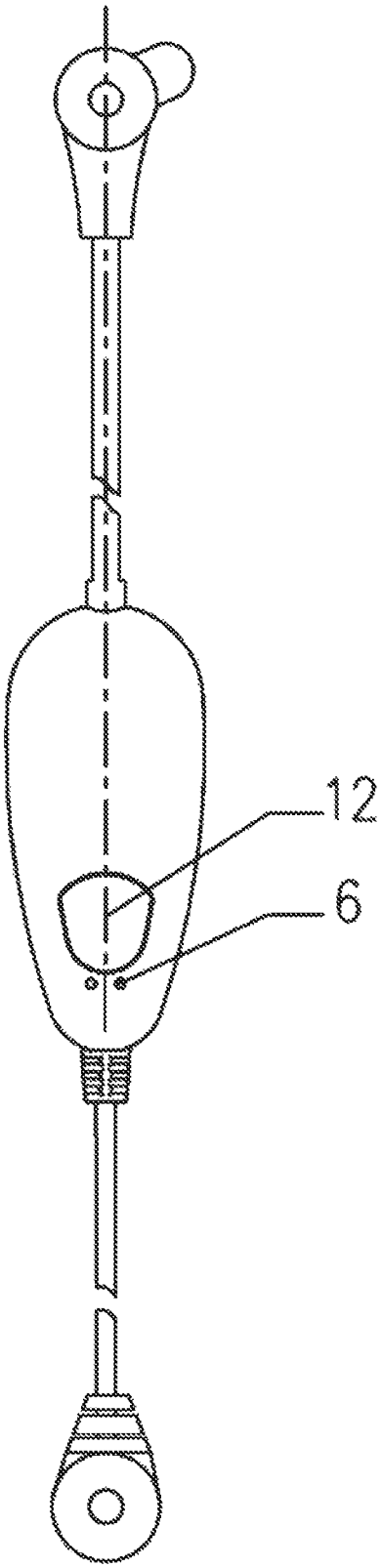
FIG. 3 is a right schematic view of the safe earphone according to the present invention, having one speaker placed flatly or slantwise and symmetrical acoustic wave concentrator.
Figure 4:
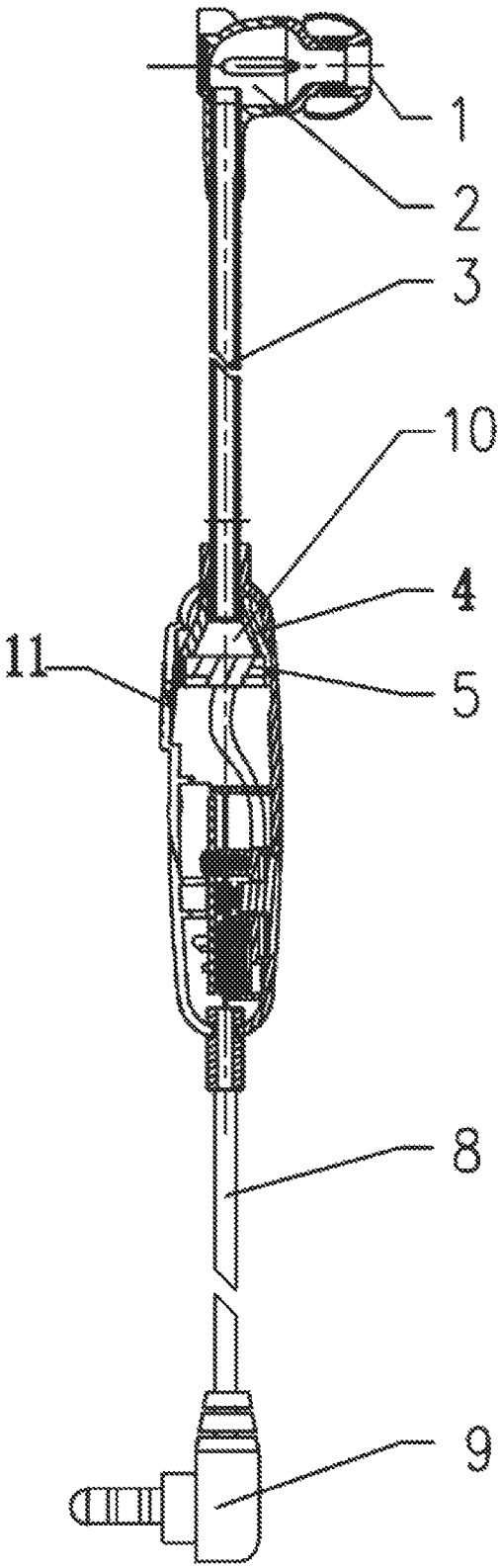
FIG. 4 is a main schematic view of the safe earphone according to the present invention, having one speaker placed flatly or slantwise and symmetrical acoustic wave concentrator.
Figure 5:
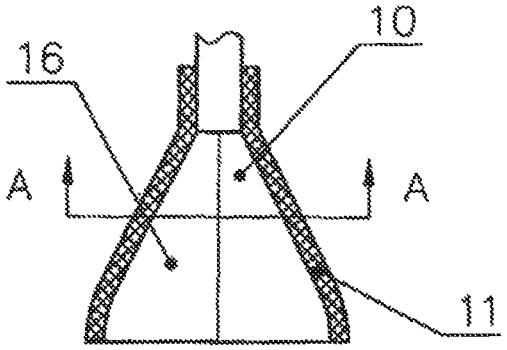
FIG. 5 is a schematic view of a small sealed box with one speaker, one sound wave transmission channel and the symmetrical acoustic wave concentrator according to the present invention.
Figure 6:
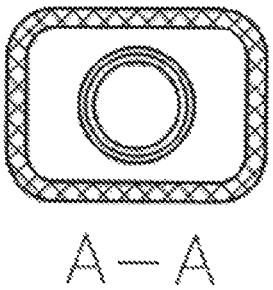
FIG. 6 is a rectangular A-A cross section view of the acoustic wave concentrator according to the present invention.
Figure 7:
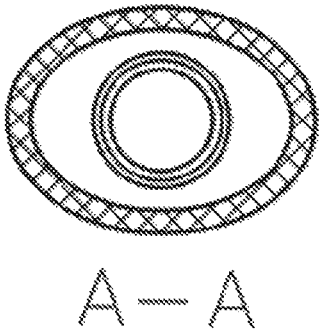
FIG. 7 is an oval A-A cross section view of the acoustic wave concentrator according to the present invention.
Figure 8:
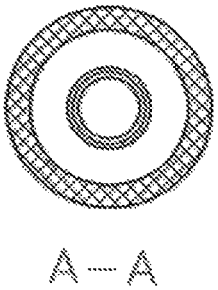
FIG. 8 is a circular A-A cross section view of the acoustic wave concentrator according to the present invention.
Figure 9:
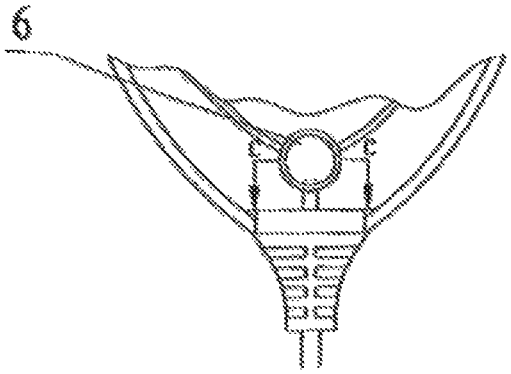
FIG. 9 is a schematic view of the installation of the microphone according to the present invention.
Figure 10:
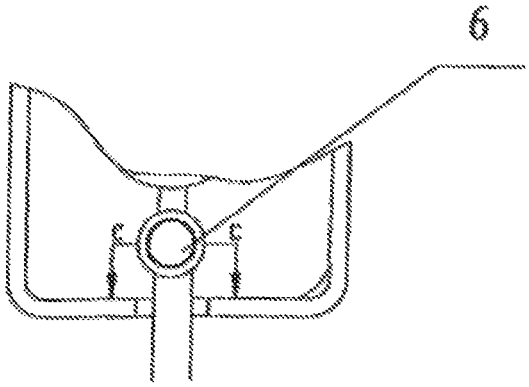
FIG. 10 is a schematic view of the installation of the microphone according to the present invention.
Figure 11:
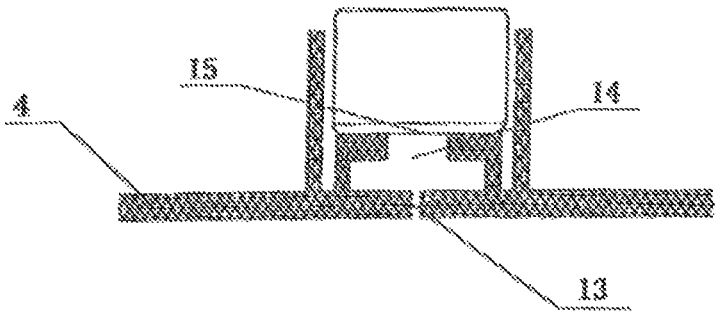
FIG. 11 is a cross section view of the installation of the microphone according to the present invention.
Figure 12:
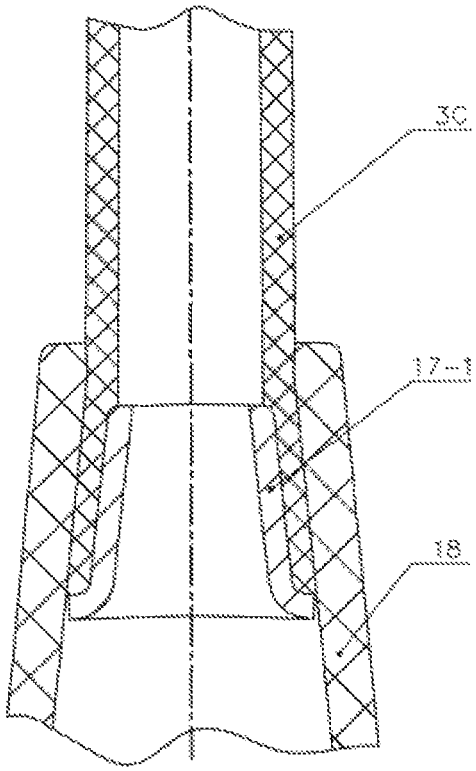
FIG. 12 is a schematic view of the fixing method of the rivet.
Figure 13:
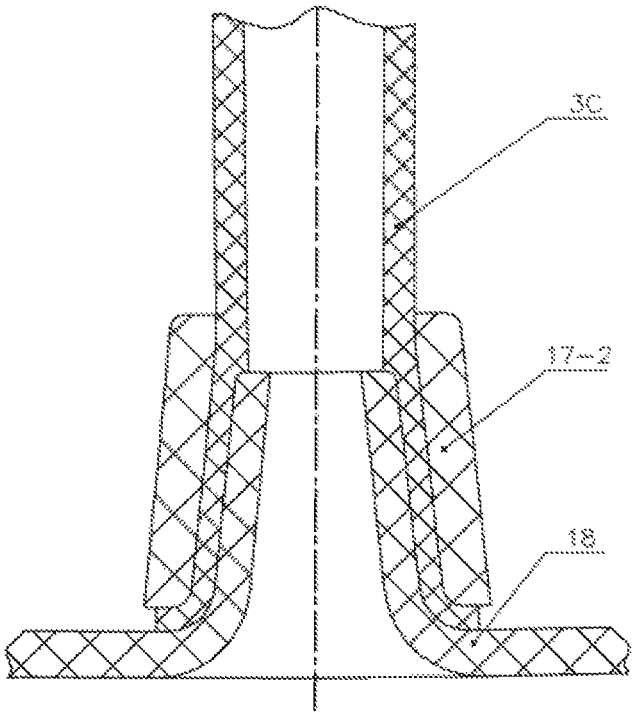
FIG. 13 is a schematic view of the fixing method of the nut.
Figure 14:
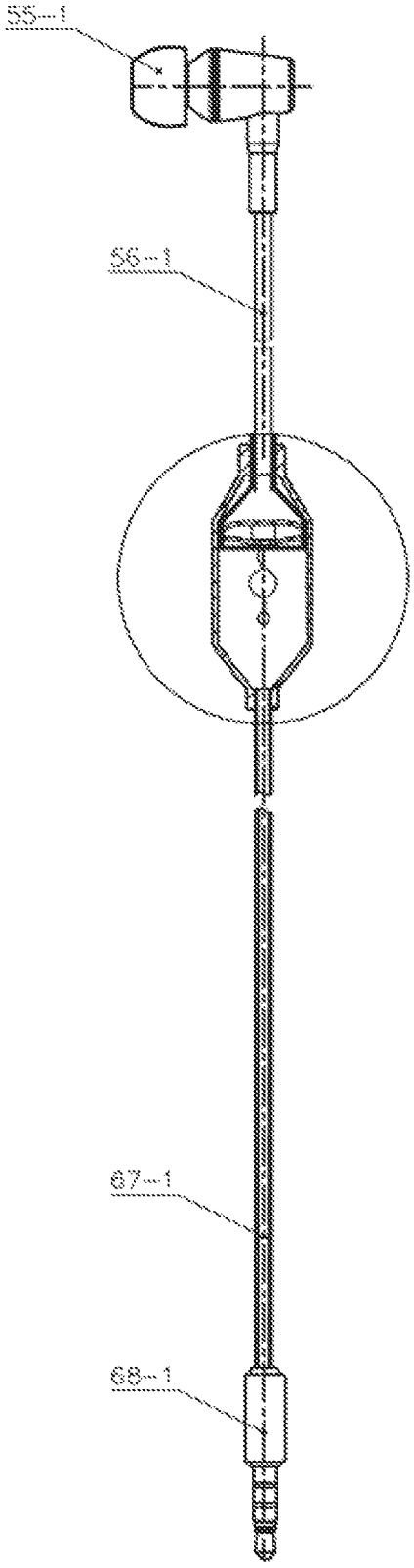
FIG. 14 is a main schematic view of the safe earphone according to the present invention, having an earplug, a micro speaker and a microphone disposed altogether in a casing of which outboard is provided with a switch.
Figure 15:
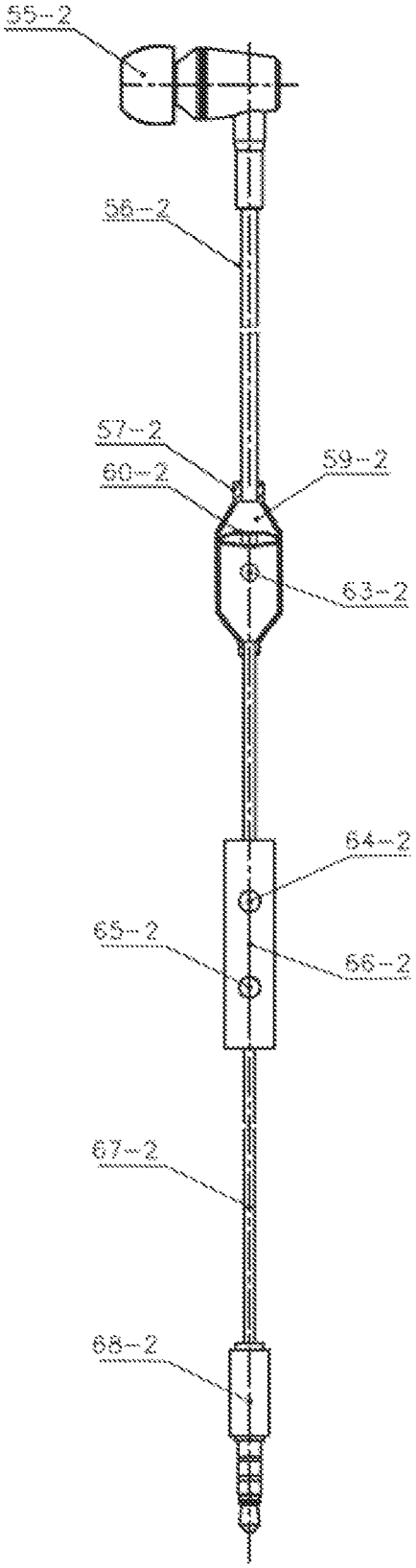
FIG. 15 is a main schematic view of the safe earphone according to the present invention, having both of an earplug and a micro speaker disposed in a casing, both of a microphone and a switch disposed in a small casing of which the other end is connected to wherein the metal shielded wire.
Figure 16:
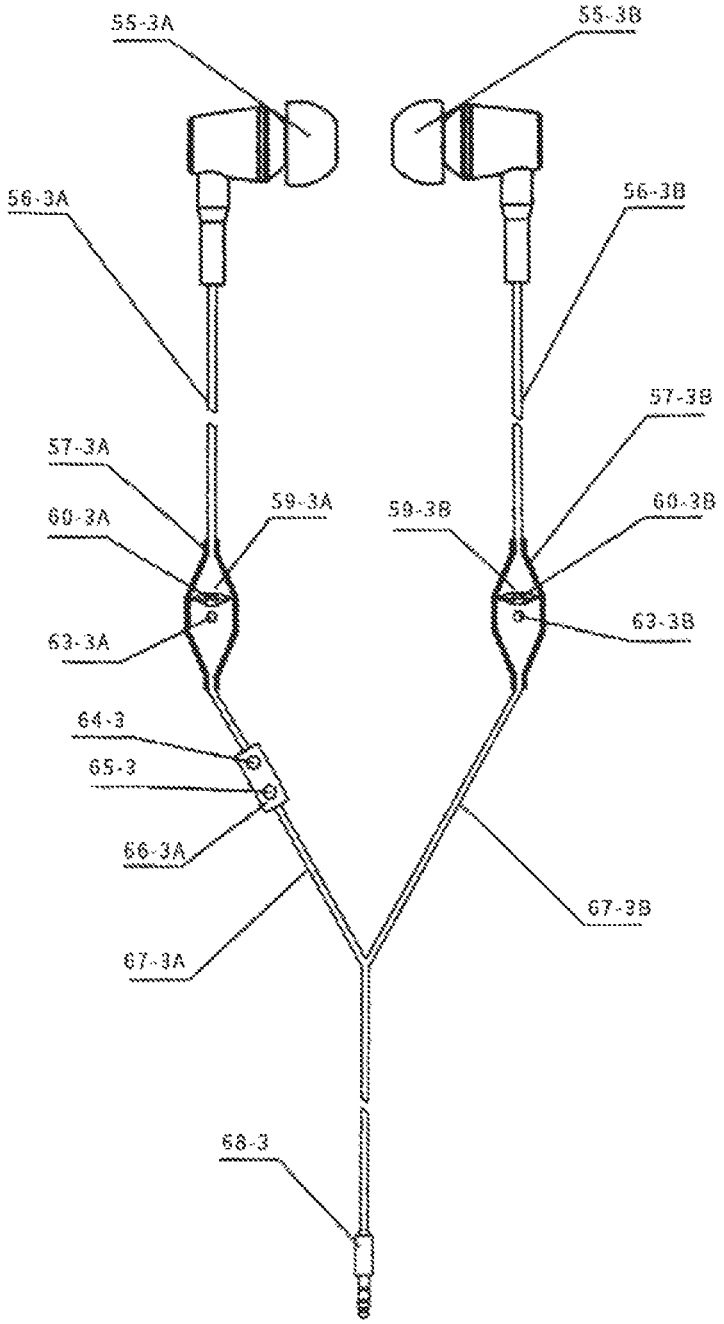
FIG. 16 is a main schematic view of the safe earphone according to the present invention, having two earplugs and two micro speaker s separately disposed in wherein the casing, both of a microphone and a switch disposed in a small casing of which the other end is connected to wherein the metal shielded wire.
Figure 17:
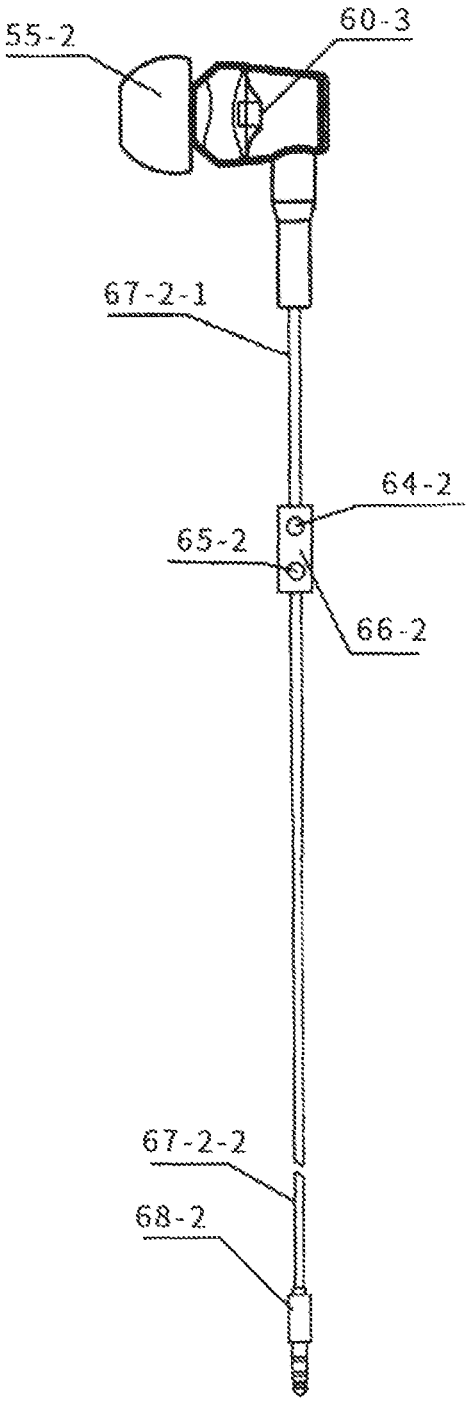
FIG. 17 is a main schematic view of the safe earphone according to the present invention, having an earplug and a micro speaker disposed in wherein the sound cavity altogether, the microphone and the switch disposed in a small casing altogether.
Figure 18:
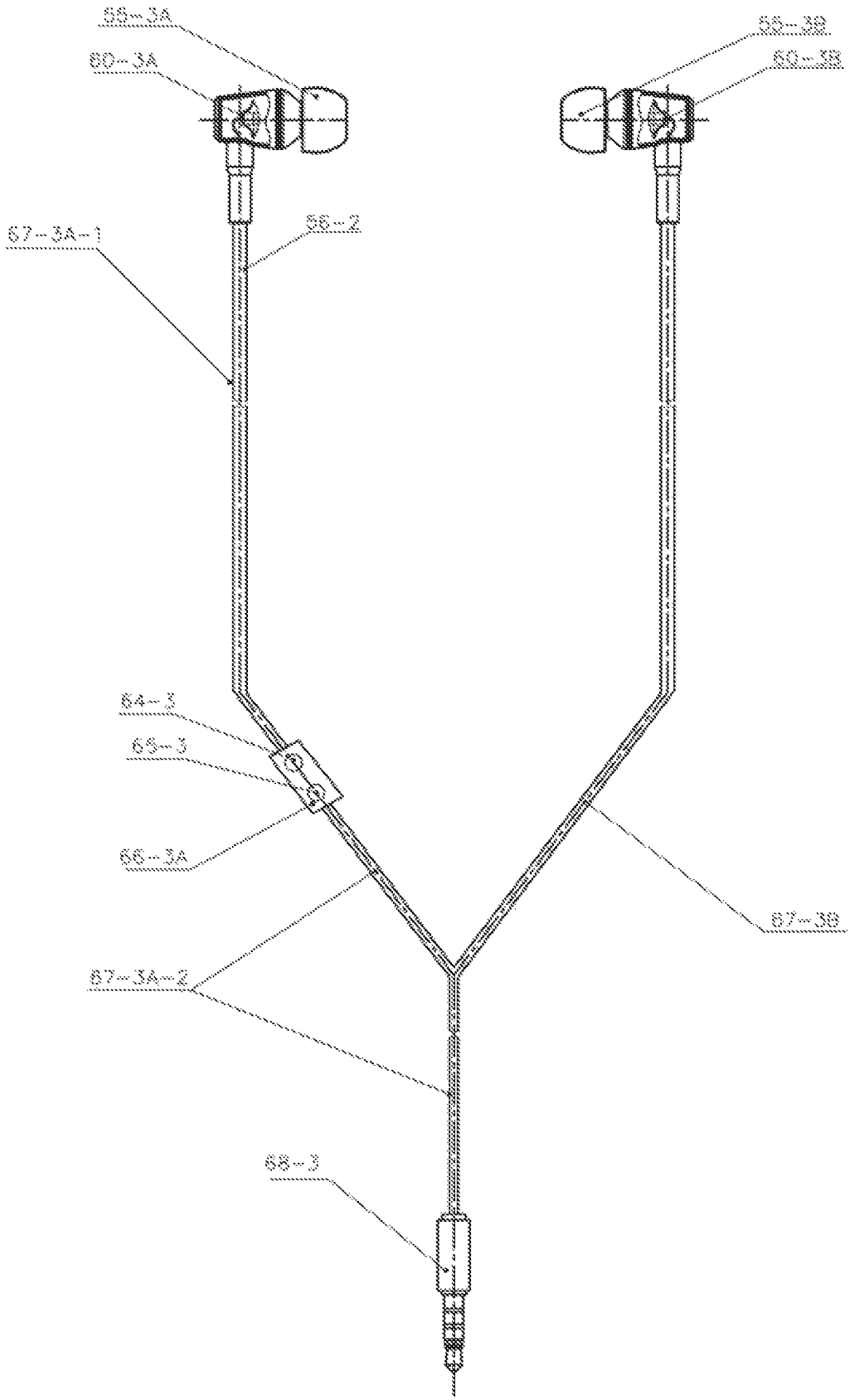
FIG. 18 is a main schematic view of the safe earphone according to the present invention, having two earplugs and two micro speaker s disposed in wherein two sound cavities altogether, a microphone and a switch disposed in wherein the small casing altogether.
Figure 19:
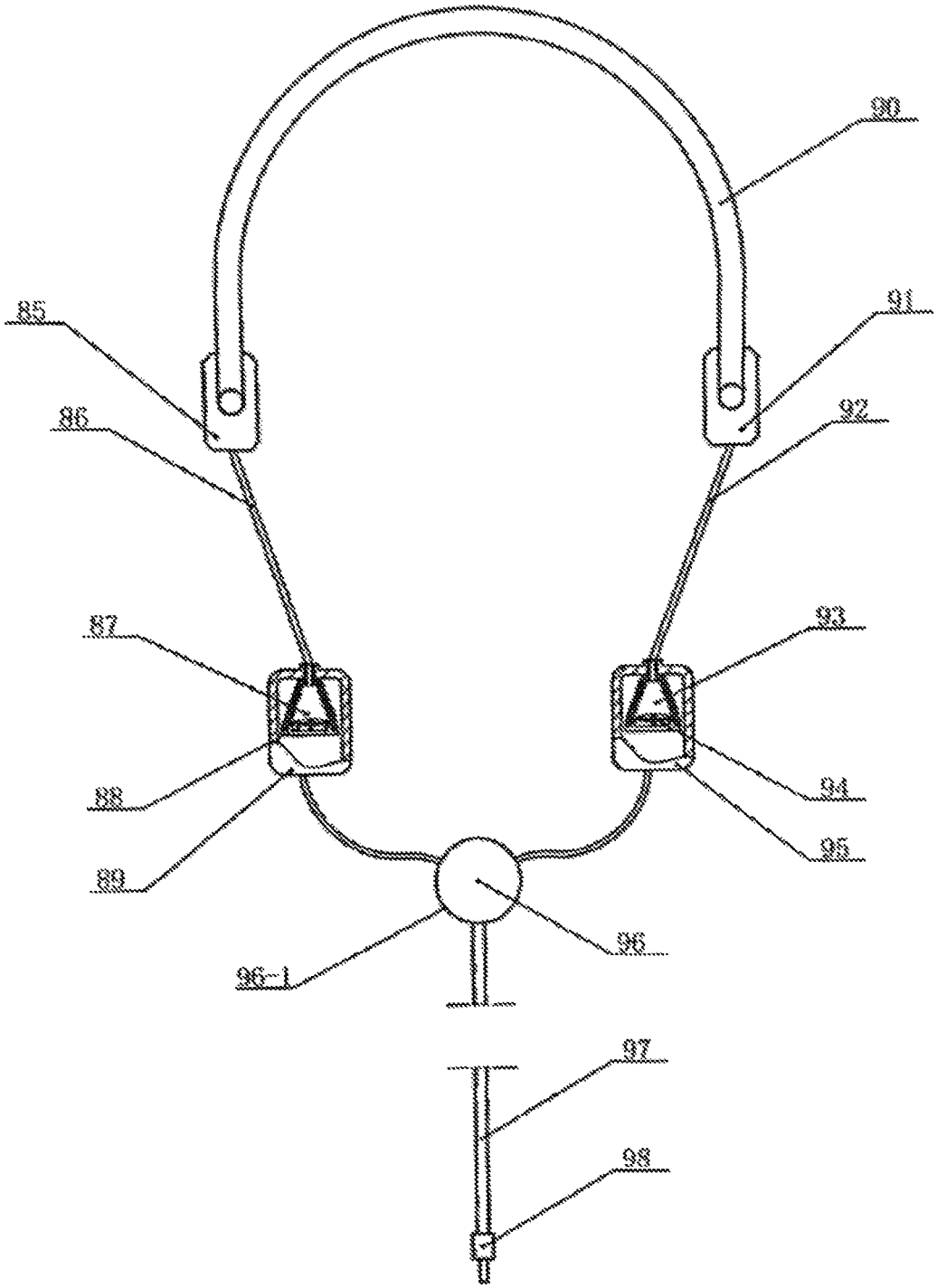
FIG. 19 is a schematic view of the over ear safe air tube stereo headphone.
Figure 20:
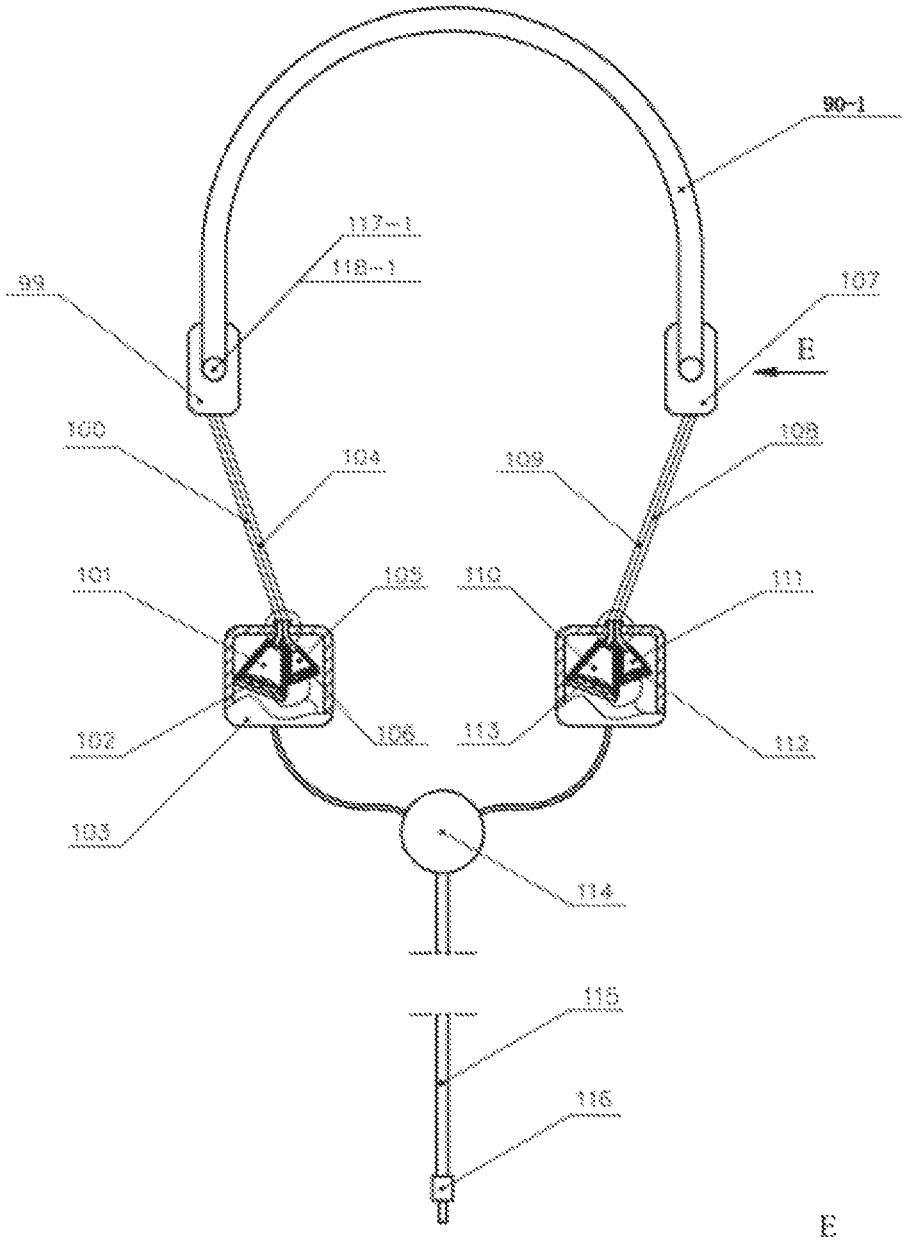
FIG. 20 is a schematic view of the earphone additionally provided with the speaker 105,111 and the corresponding air tubes and sound cavities based on the structure as FIG. 19.
Figure 21:
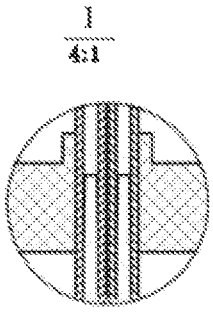
FIG. 21 is a cross section view of the sealed joint of the air tube of two sound cavities and the acoustic wave concentrators.
Figure 22:
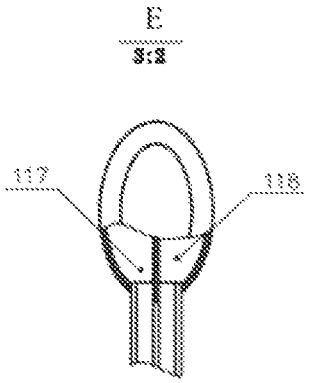
FIG. 22 is a cross section view of two sound cavities.
Figure 23:
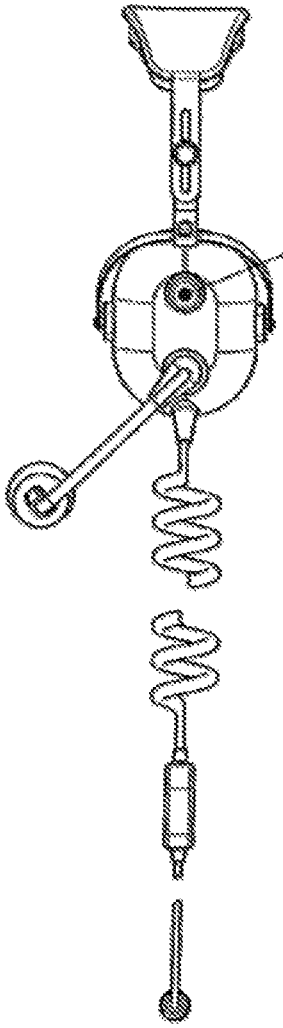
FIG. 23 is a side section view of the over ear radiation proof headphone adopting with the metal shielded wire to achieve radiation protection.
Figure 24:
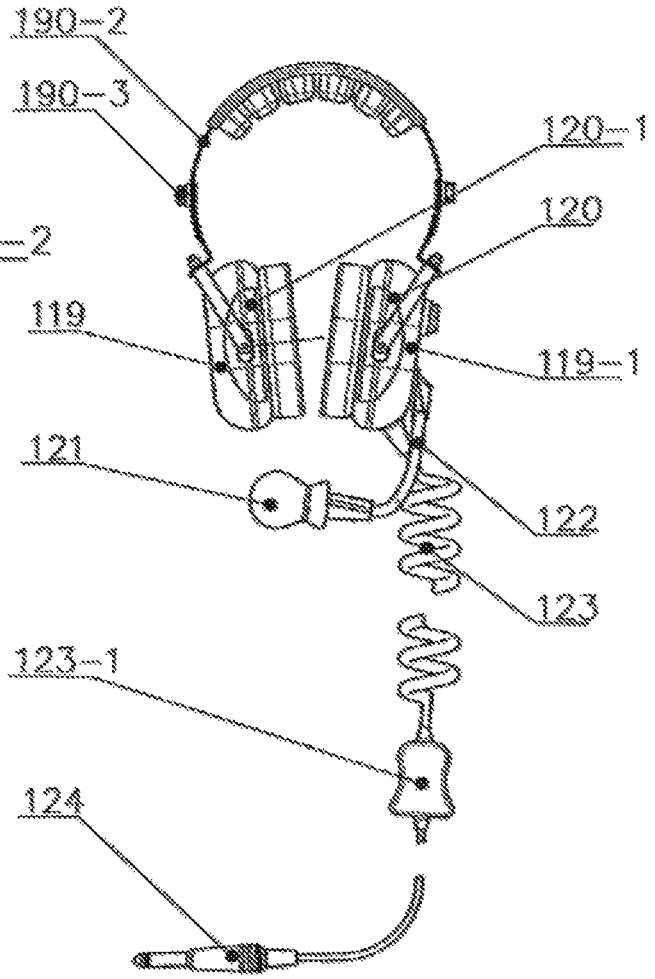
FIG. 24 is a schematic view of the over ear radiation proof headphone adopting with the metal shielded wire to achieve radiation protection.
Figure 25:
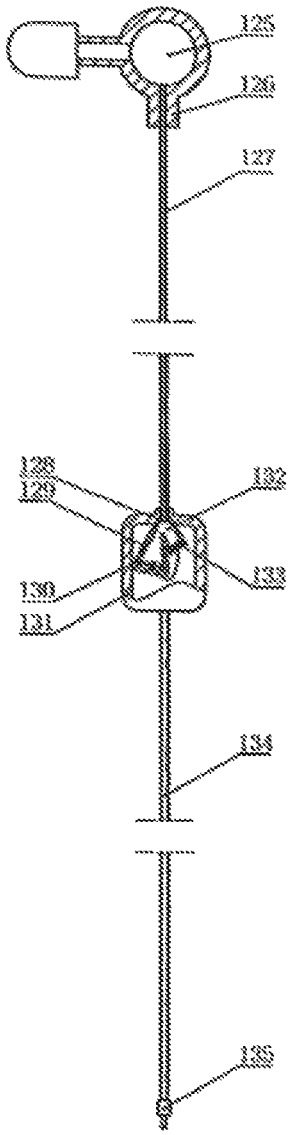
FIG. 25 is a schematic view of the wired earphone, having two speakers with different frequency response connected to a sound chamber by an air tube for listening.
Figure 26:
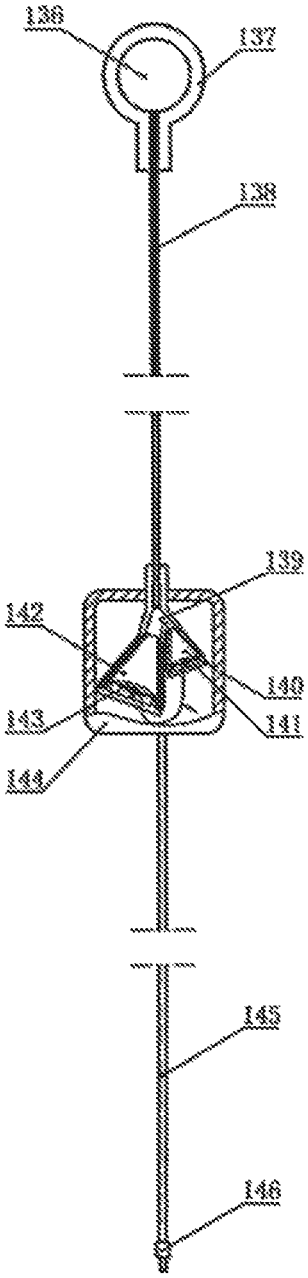
FIG. 26 is a schematic view of the wired earphone, having two speakers with different frequency response connected to a sound chamber with an air tube for one ear listening.

A noise-reduction earphone, includes an earphone head (1), provided therein with a sound cavity (2) which has a first end having a sound outlet;

a main body (4), provided therein with an acoustic wave concentrator (10) with a channel opening is connected to a second end of the sound cavity (2) through a sound wave transmission channel (3);

a micro-speaker (5), wherein the acoustic wave concentrator (10) is between the micro-speaker (5) and the sound wave transmission channel (3);

the micro-speaker is connected with a first end of a conductor (8) outside the main body (4) and a second end of the conductor (8) is connected with a plug (9).

a microphone is set as a conversion system converting an active audio signal into a passive transmission signal and restoring to the active audio signal again.

Embodiment 2

Figure 32:
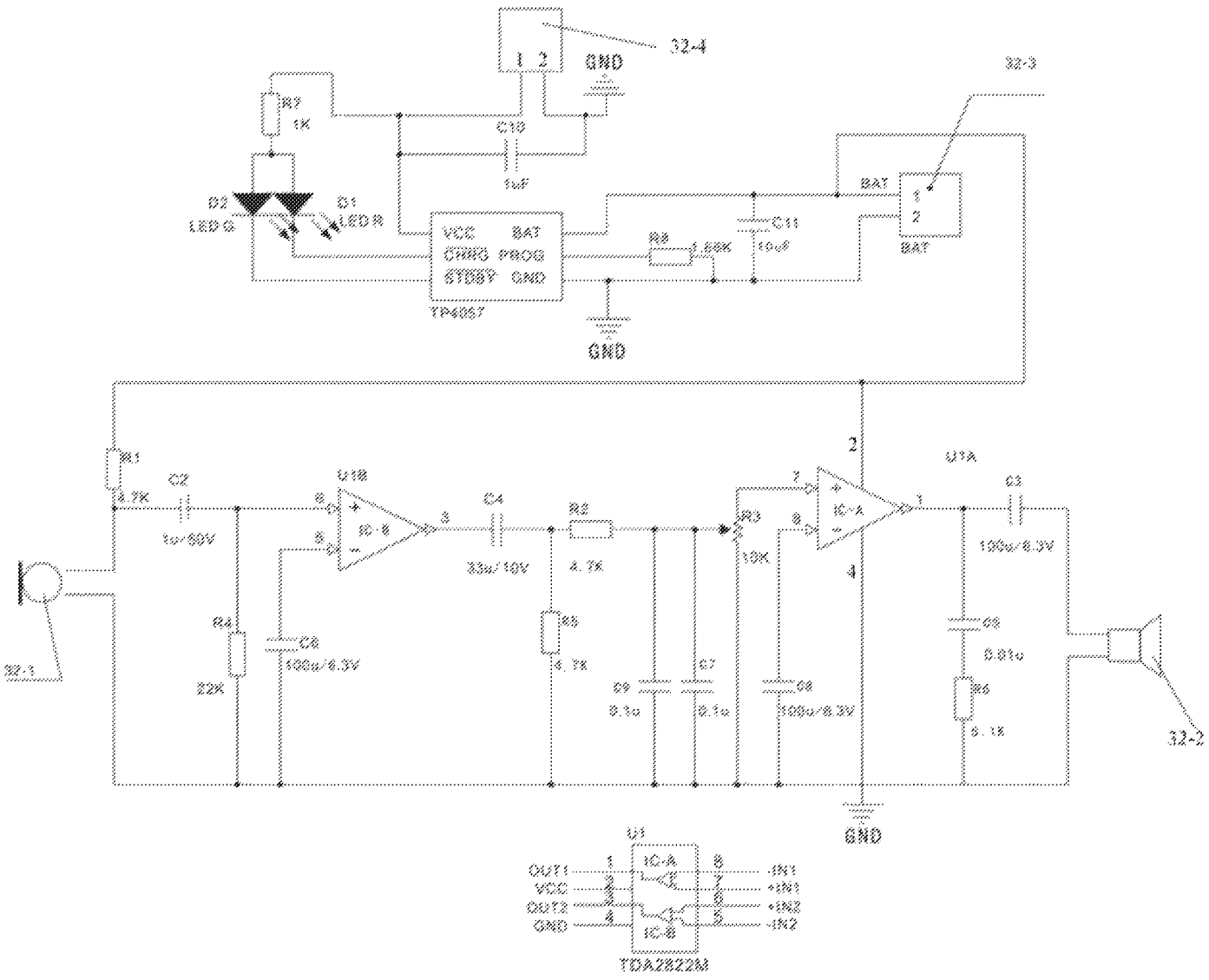
FIG. 32 is an circuit principle diagram of an audio converter that amplifies the audio signal of a microphone and convert it into a sound, and has a principle circuit of charging and power supply. The circuit can change the amplification power of the circuit according to the length of the microphone air tube to select different chips and different circuits.
Figures 1, 32:
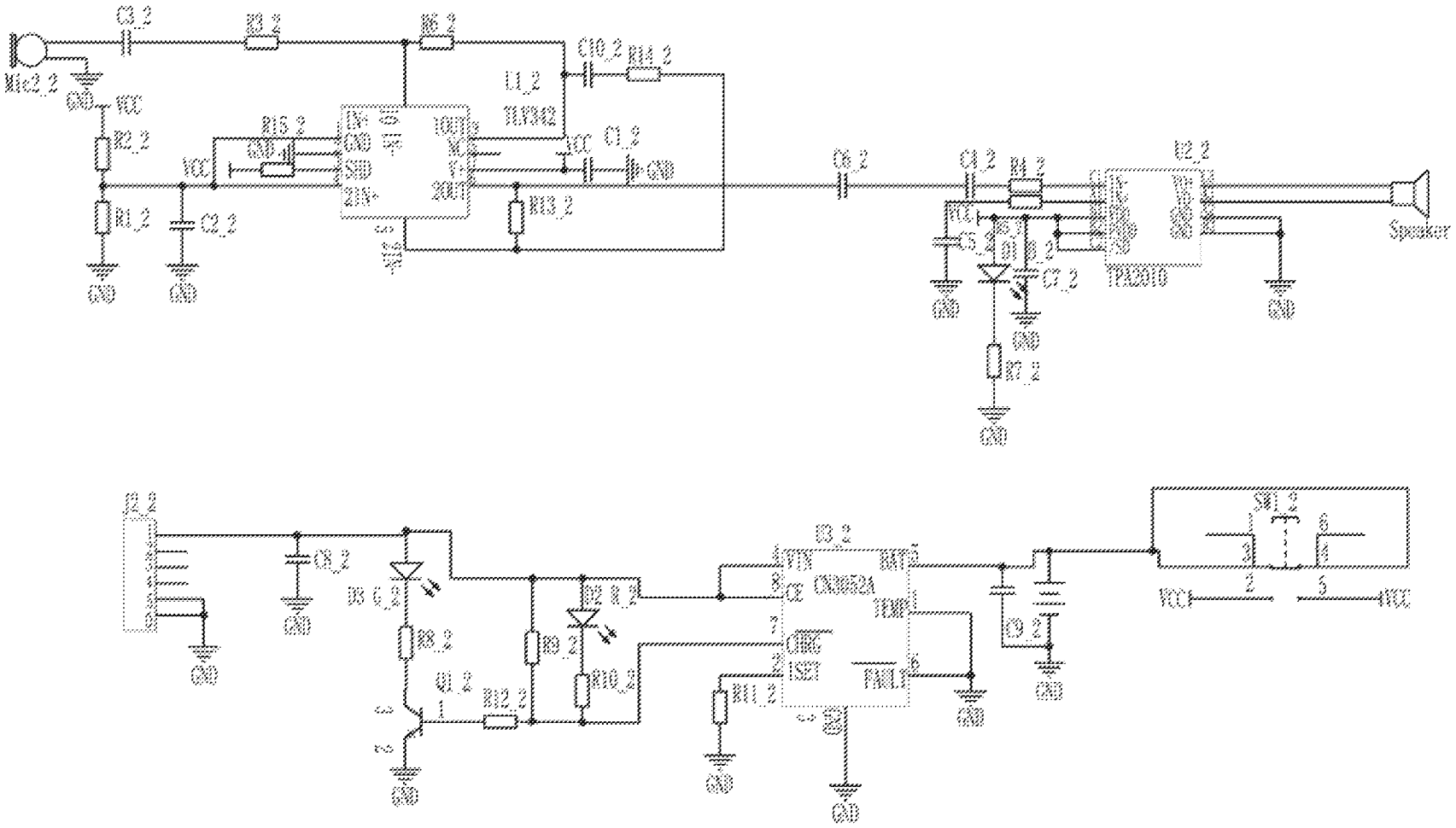
Figure 33:
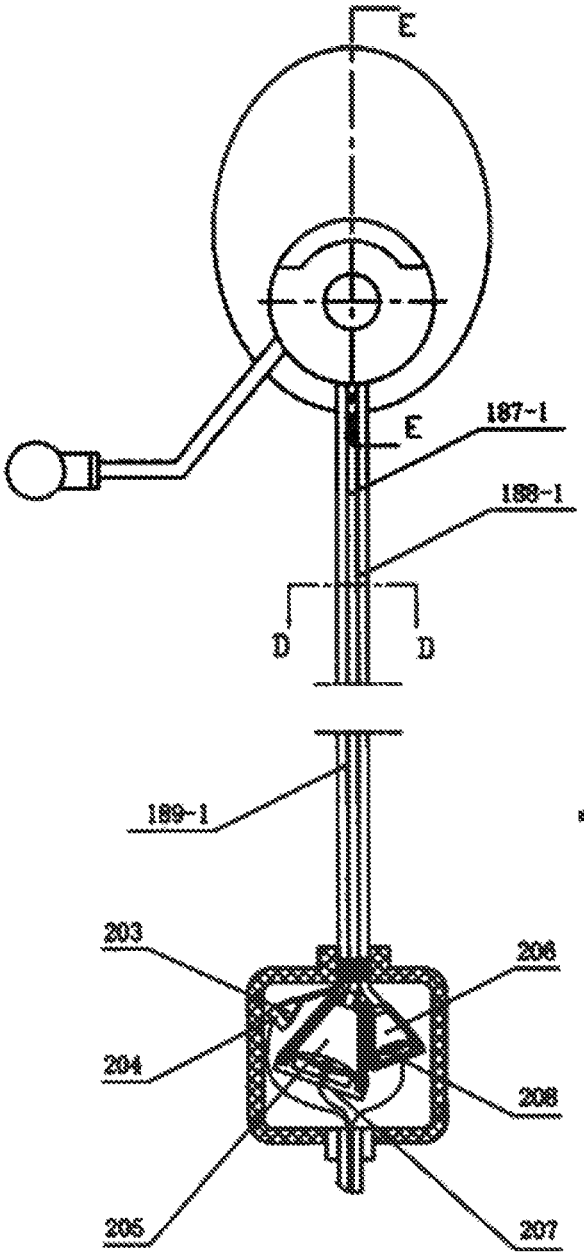
FIG. 33 is a schematic view of structure of the noise reduction safe over ear headphone, having left and right ear sound wave channel, speakers, air tubes of microphone and the first microphone.
Figures 2, 33:
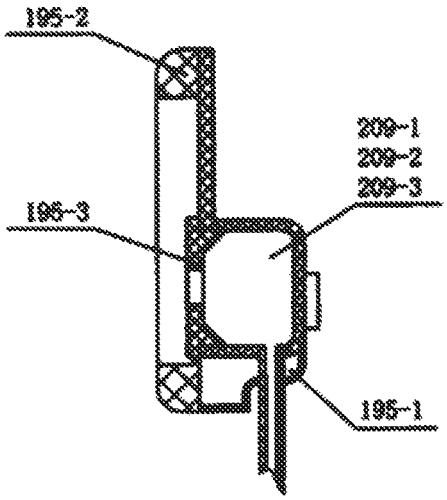
Figures 1, 33:
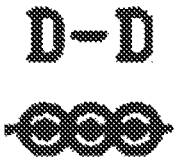
Figures 4, 33:
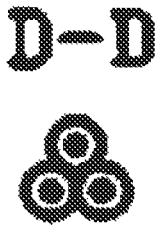
Figures 3, 33:
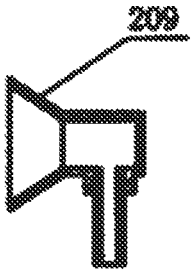

The noise-reduction earphone as mentioned above, a binaural over-ear headphone in the present embodiment is provided with a left ear cup (195), a left ear casing (195-1), a right ear cup (194), a right ear casing (195-2), a headband (185), a switch and its switch housing (191), a noise reduction transmission arm (198), and a noise reduction converter (196), a housing (195-1), a speaker housing (190), a plug (193), and is provided with a noise reduction conversion system: converting the transmission from the active audio signal into the passive audio signal, setting the first microphone wired to the circuit of an audio amplifier (As FIG. 32) to push the speaker, the circuit amplification power and stages and performance is decided by the length and diameter of the selected air tube, the big end of the acoustic wave concentrator (205) (206) is connected to the sound outlets of the speaker (207) (208) and the small end is riveted to the one end of microphone air tubes (188-1) (187-1) of which the other end is connected to the small end of the sound cavity (203) of taper shape, the big end of the sound cavity (203) is connected to the a sound receiving face of a second microphone (204), the connection from the sound outlets of the speaker through the air tube to the sound receiving face of the second microphone is sealed; the other end of the second microphone is wired to the one end of the metal shielded wire (192) of which and the other end is connected to the one end of the plug (193), the other end of which is connected to the socket of communication device;

the active part of the conversion system is provided with an electronic circuit board, a battery to supply power circuit and its elements, a charging circuit and a charging socket connected to the battery, a power LED and a power switch, and the active signal elements of the aforesaid conversion system are all mounted in the converter, the speaker of the conversion system is mounted in the middle of the first microphone, or the outboard of the sound cavity inside the left ear housing, (as FIG. 32).

The signal transmission of the microphone is converted from active transmission into passive transmission then restore to active transmission again, which allows setting the air tube very long, and the microphone keeps at a very close distance to the sound outlet to achieve noise reduction and meanwhile super-highly protect the ear and brain from the harm of communication devices.

the one end of the left ear air tube (187-1) is connected to the inlet of the sound cavity producing the sound (209-1), meanwhile the other end is connected to the small end of the acoustic wave concentrator (205) of which the big end of wherein the acoustic wave concentrator is connected to the speaker (207), the other end of which is wired to the metal shielded wire (192); the one end of the air tube of right ear (188-1) is connected to the entry of the right sound cavity producing the sound when the other end of the air tube of right ear passes through the left ear casing (195-1) along the outboard of the metal headband (186) with the left ear air tube (187-1) parallel to the speaker casing (190) and is connected to the small end of the right acoustic wave concentrator, the other end of which is connected to the one end of a right ear speaker (208), the other end of the right ear speaker (208) is wired to the one end of the metal shielded wire (192) through the switch (191), the other end of wherein the metal shielded wire (192) is connected to the plug (193).

The three air tube are parallelly bonded sides by sides, covered by flexible material outside.

Embodiment 3

Figure 34:
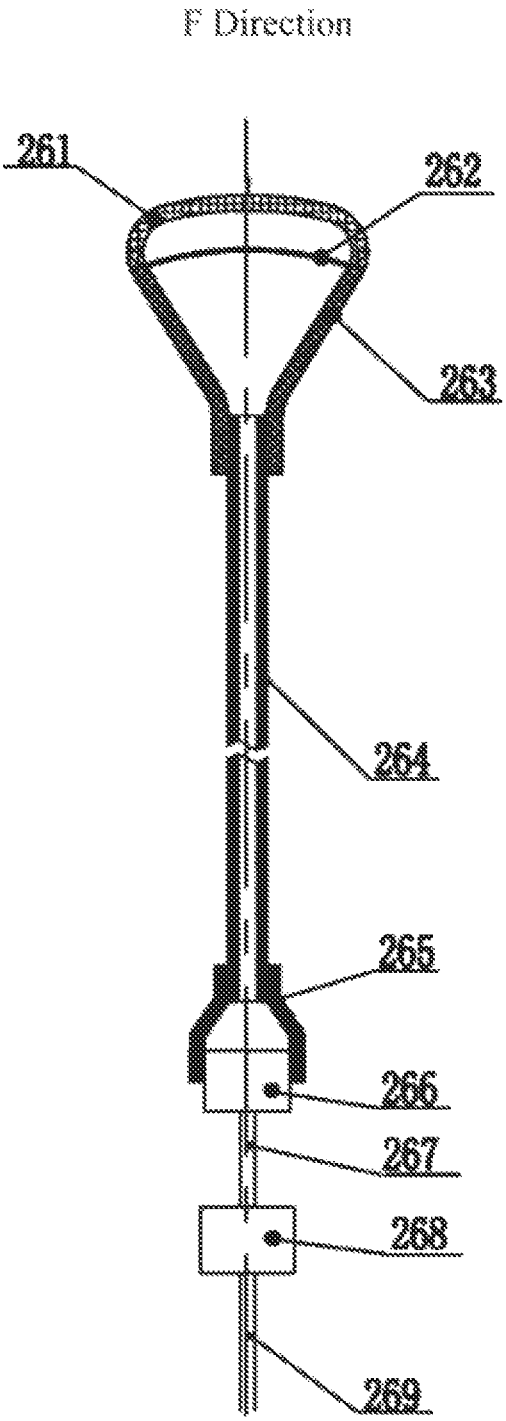
FIG. 34 is a schematic view of the structure of the air tube microphone.
Figure 35:
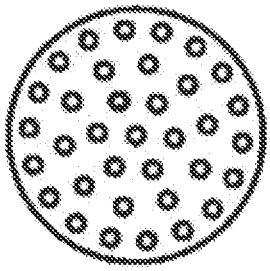
FIG. 35 is a direction view of the cover of the air tube microphone.
Figures 36, 37:
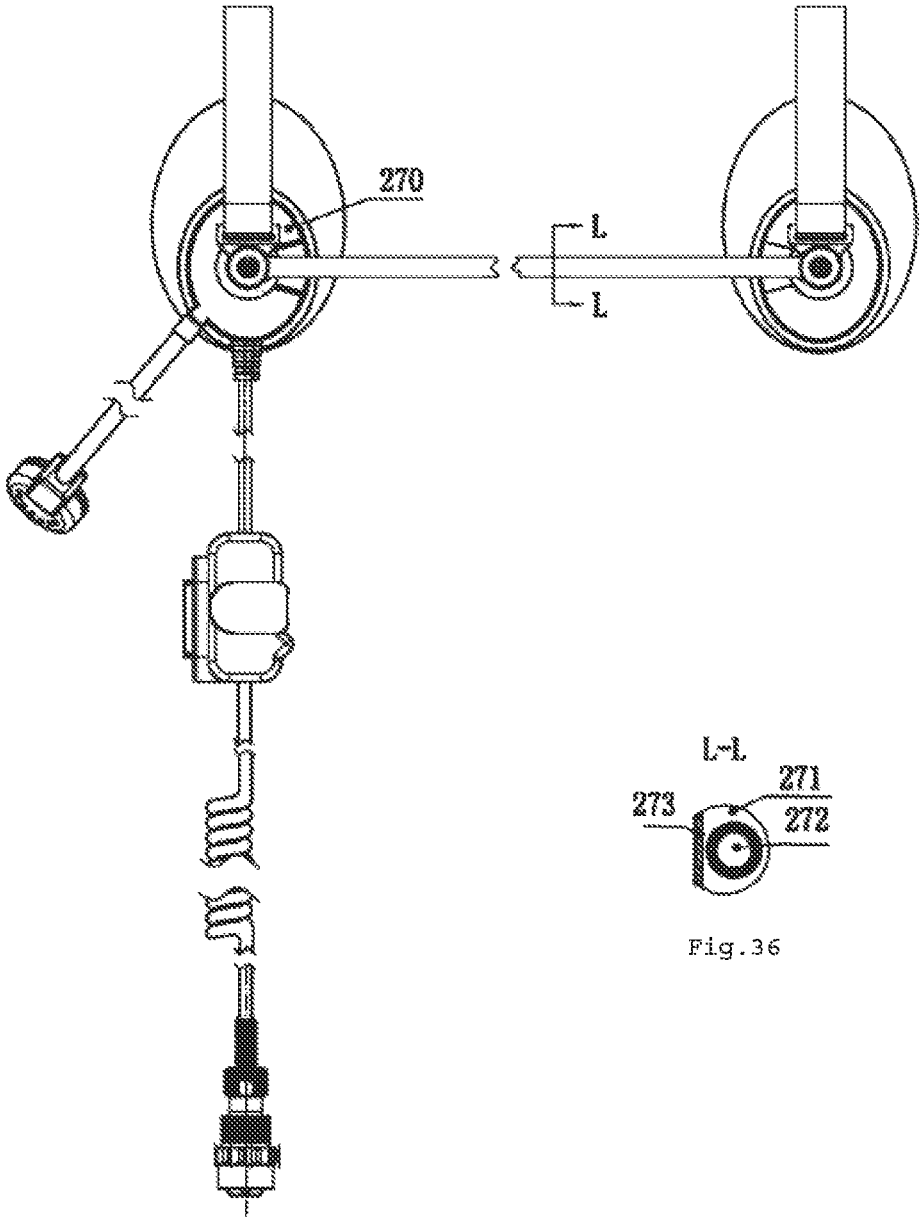
FIG. 36 is a cross section view of the structure of the steel bow and the branch air tube of right ear bonded together.
FIG. 37 is a schematic view of the unfolded bow in a movable triangular.
Figure 38:
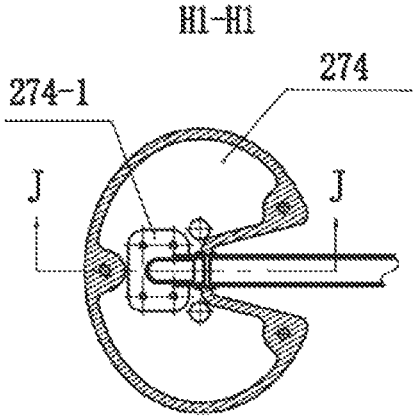
FIG. 38 is the cross section view of FIG. 30H1-H1, a schematic view of the connection between the air tube of right ear and the bend.
Figure 39:
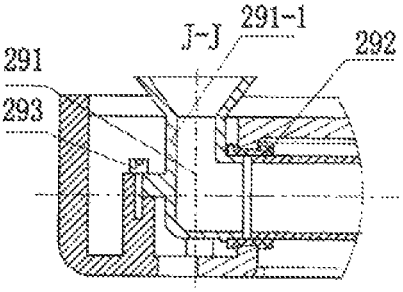
FIG. 39 is a J-J cross-sectional view of FIG. 38, representing a installation schematic view of the branch air tube of right ear connected to the seal elbow.
Figure 40:
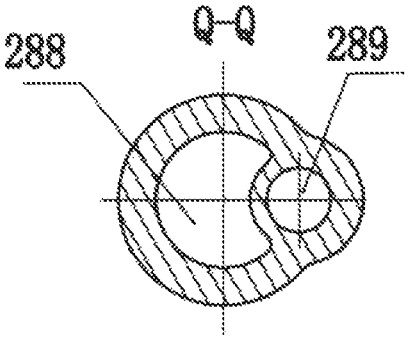
FIG. 40 is the cross section view of the combined air tube.
Figure 41:
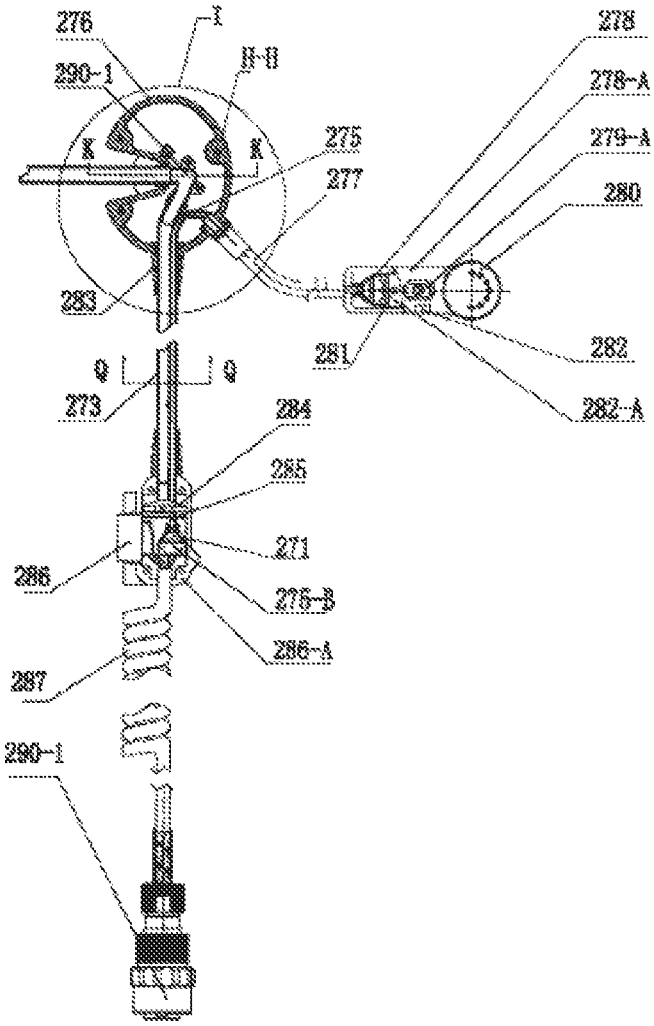
FIG. 41 is a schematic view of the connections between the tee of the left ear, the converter and the input of the big speaker and the output of the second receiver.
Figure 42:
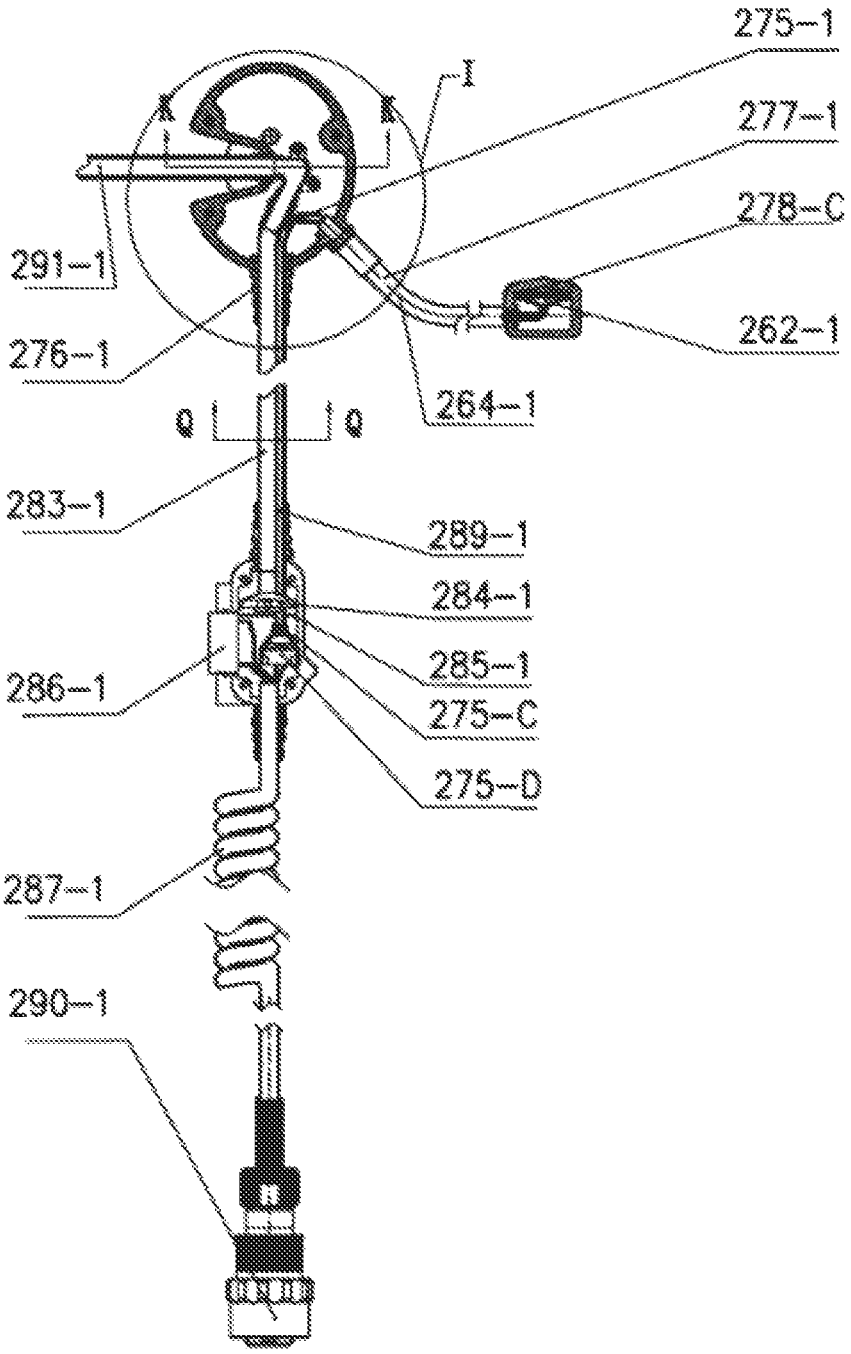
FIG. 42 is a schematic view of the installation and connection of an air tube microphone in a mono headset.
Figure 43:
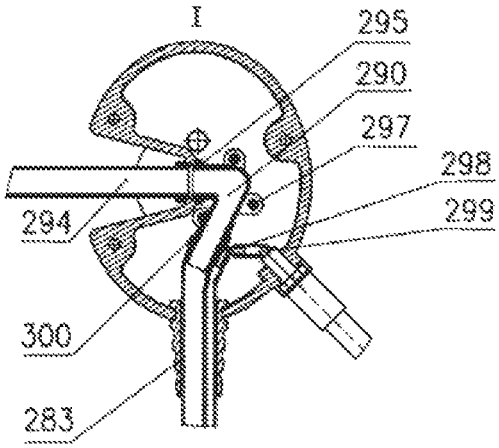
FIG. 43 is a schematic view of the installation of the tee (290) in the left ear casing, the connection with the combined tube, and the connection with the air tube of right ear.
Figure 44:
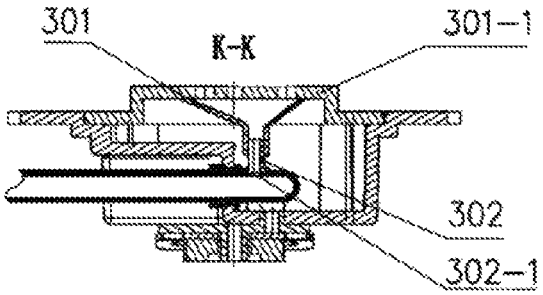
FIG. 44 is a schematic view of the connection of the tee (290) with the left sound cavity pathway.
Figure 45:
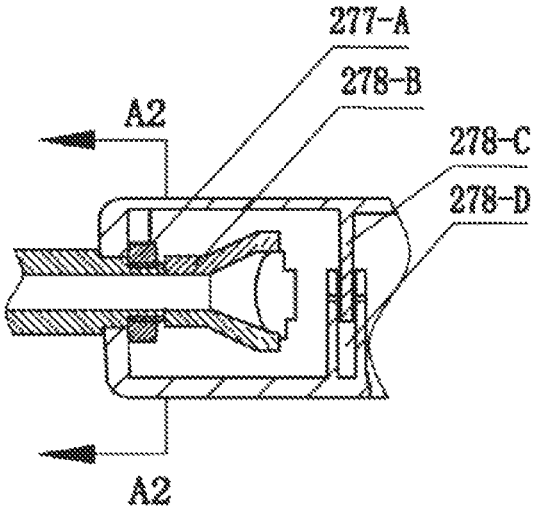
FIG. 45 is a schematic view of the installation of a converter output speaker and the installation of a converter.
Figure 46:
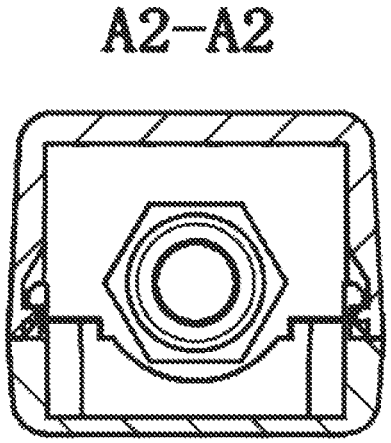
FIG. 46 is a cross section view of A2-A2.
Figure 47:
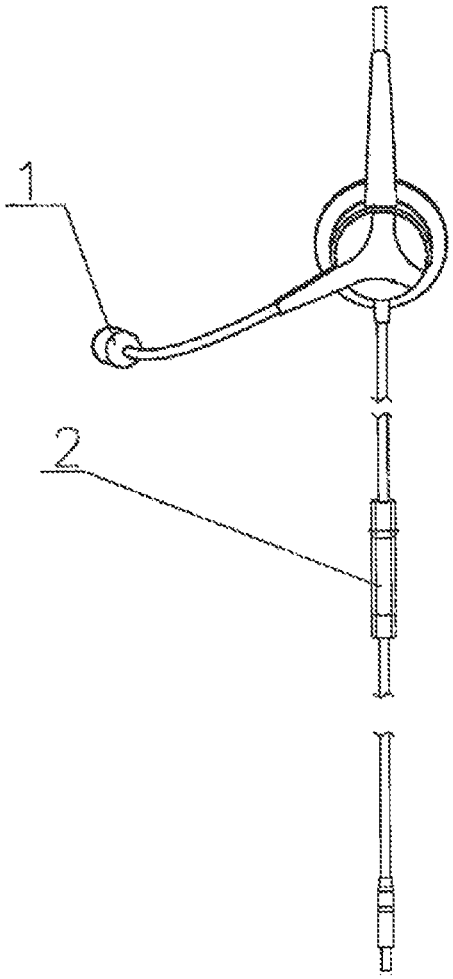
FIG. 47 is a side section view of the structure of the noise reduction mono over ear headphone.
Figure 48:
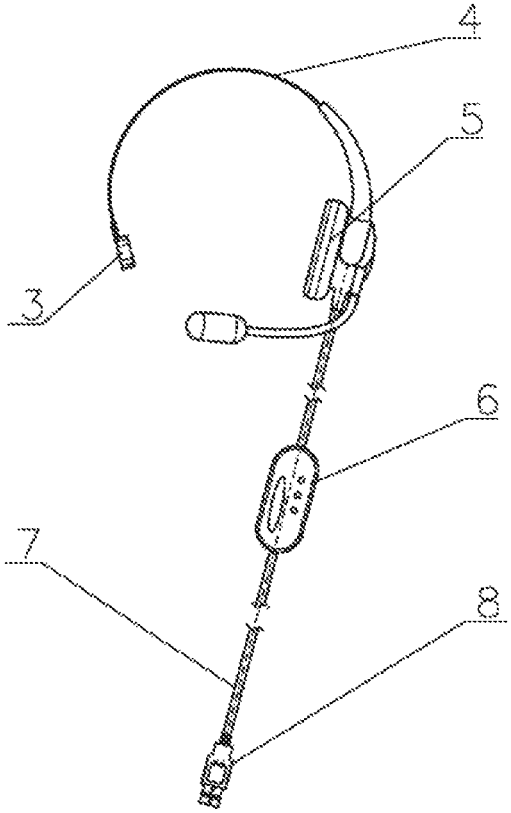
FIG. 48 is a front view of the structure of the noise reduction mono over ear headphone.
Figure 49:
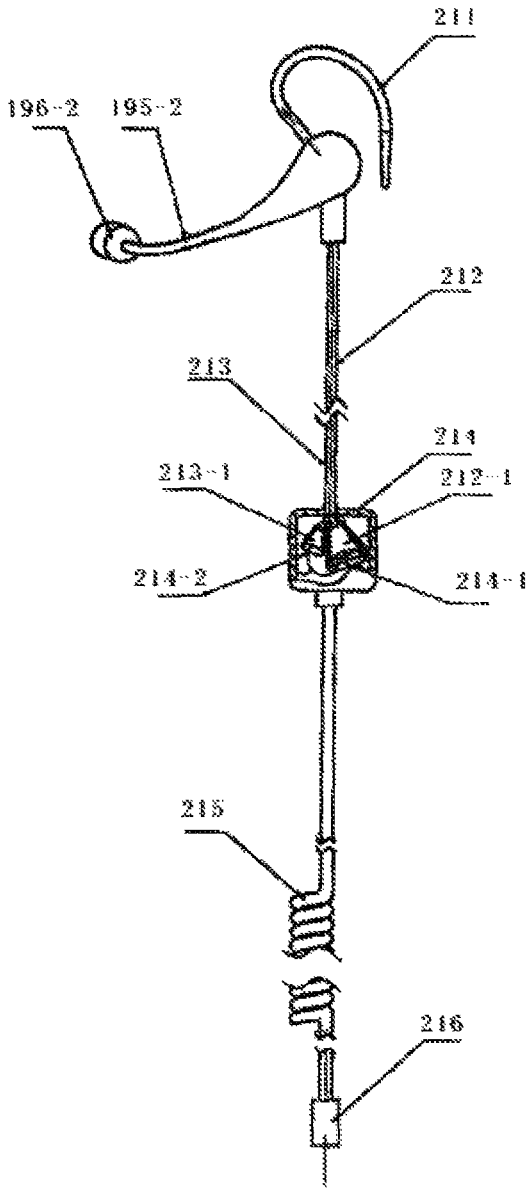
FIG. 49 is a schematic view of the structure of the noise reduction safe mono ear hook earphone.
Figures 50, 51, 52:
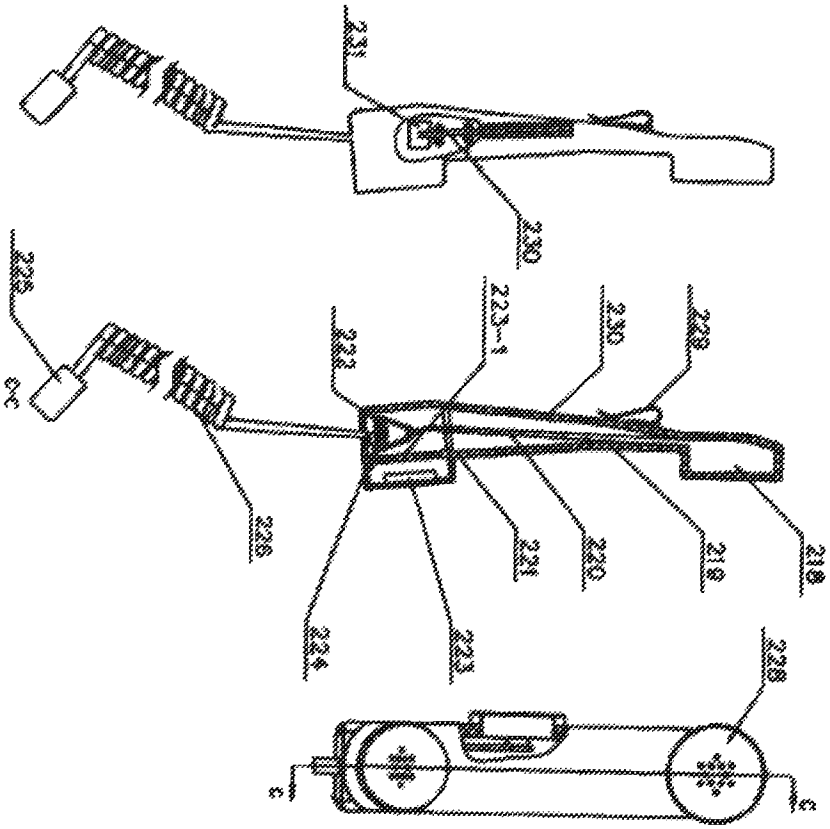
FIG. 50 is a full section view of the structure of the portable hand-held safe headset.
FIG. 51 is a schematic view of both of the appearance of the portable hand-held safe headset and the long pole switch.
FIG. 52 is a schematic view of the structure of both of the appearance of the portable hand-held safe headset and a switch.
Figure 53:
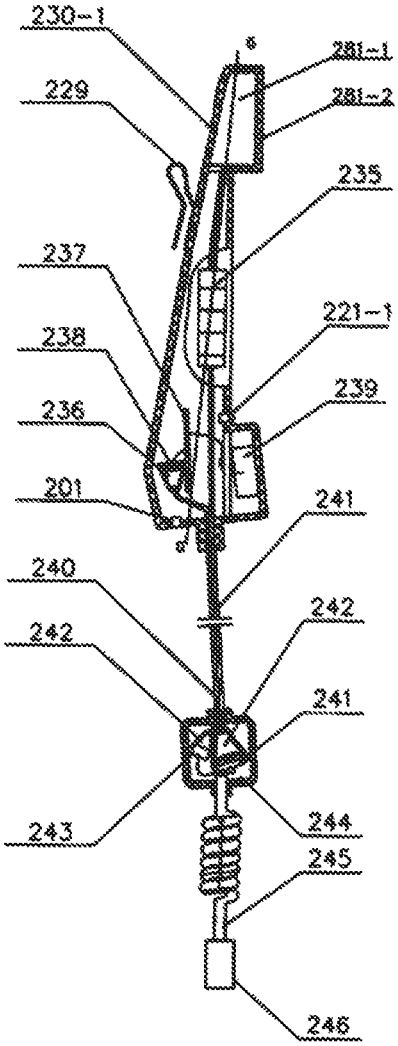
FIG. 53 is a schematic diagram of the structure and path of the portable hand-held safe headset with active and passive conversion of microphone signals.
Figures 1, 53:
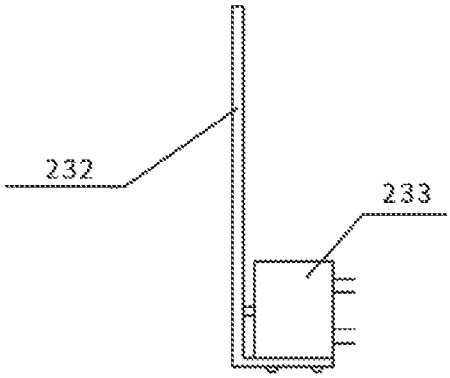
Figure 54:
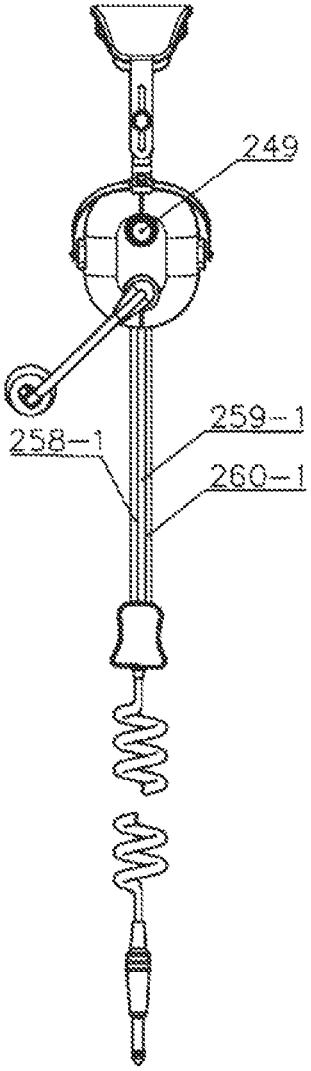
FIG. 54 is a side section view of the structure of the noise reduction aviation over-ear safe headphone.
Figure 55:
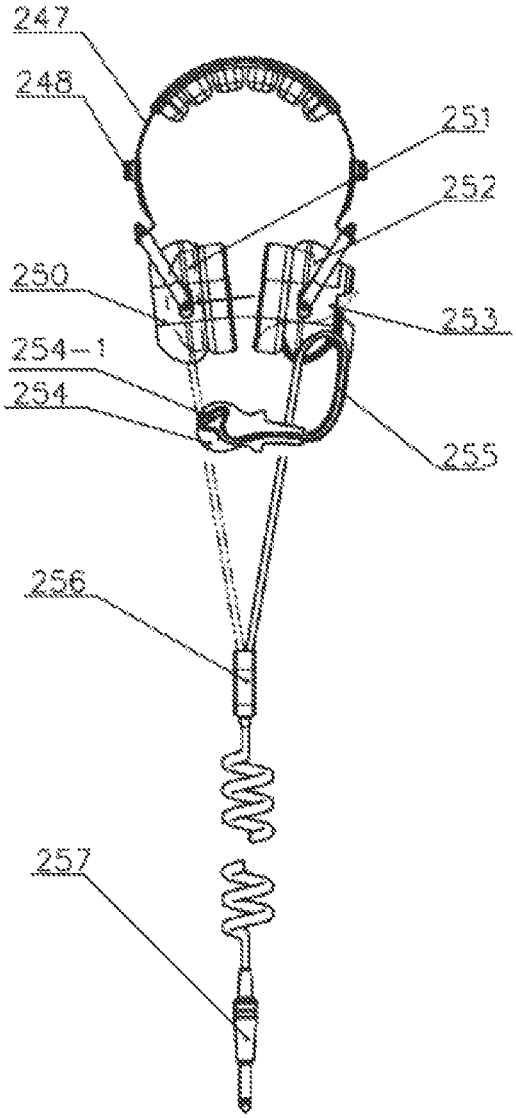
FIG. 55 is a front section view of the structure of the noise reduction aviation over-ear safe headphone.

Remote noise-reduction air tube microphone as FIG. 34 has a diaphragm (262) mounted at the big end of the acoustic wave concentrator (263), and a cover (261) with several holes is arranged on the outside of the diaphragm (262), and then the diaphragm (262) is tightly fasten at the big end of the acoustic wave concentrator (263) of which the small end is connected to the one end of the air tube (264), the other end of the air tube is connected to the small taper-shaped end (sound amplifier) of which the big end is connected to the microphone, the joint of the sound receiving face of the microphone (266) to the cover (261) is sealed;

the conductor (267) of the small microphone is connected to the amplifier (268) of which the output terminal is connected to the metal shielded wire and then connected to the communication devices by the connector;

the length of the air tube (264) is set as 300 mm, the diameter of the hole is set as 3 mm, the device can install the microphones of all safe earphones into the horn (265) instead of the small microphone (266) which is placed outside the length of the air tube in current technology.

Embodiment 4

The megaphone in the present embodiment is composed of a cover (261), a diaphragm (262), an acoustic wave concentrator (265) and an air tube, the megaphone can connect microphones which is located far from the mouth to the mouth by using different-sized taper-shape cavity to achieve the purpose of noise reduction and radiation prevention. The rest of the setting structure is the same as that in Embodiment 3.

Embodiment 5

In the present embodiment, a binaural over-ear noise-reduction air tube headphone with mono channel is provided with a binaural over-ear headphone in the present embodiment is provided with a left ear cup (195), a left ear casing (195-1), a right ear cup (194), a right ear casing (195-2), a headband (185), a switch and its switch housing (191), a noise reduction transmission arm (198), and a noise reduction converter (196), a housing (195-1), a speaker housing (190), a plug (193);

a plug (290) receiving the signal from the communication devices is connected to the one end of the big speaker (284) by a metal shielded wire (289), the other end of the speaker (284) is connected to the big end of the acoustic wave concentrator (284-1) of which the small end is connected to a big tube (288) of the combined air tube (283), the other end of the big tube (288) is connected to the long end of the tee (290) and is tightly fasten with a cable (300), and the other end of the tee (290) is connected to the one end of a sealing ring (295) of which the other end is connected to a branch air tube of right ear (294), the other end of which is connected to a sealing ring (292), the other end of the sealing ring (292) is connected to an elbow (291) of which the other end is connected to a sound cavity (291-1), the bottom of the elbow is provided with a mounting plate (274-1) fixed in the right ear casing (274) with four screws (293), a positioning pin is arranged inside the right ear casing to position the elbow, the outlet of the sound cavity is provided with a cover plate with several pierced holes;

the top side of the tee (290) is provided with a small pipe (302) having the small acoustic wave concentrator (302-1) at one end connected to the tee (290), the other end of the small pipe (302) is connected to a small sound cavity (302-1) having a cover plate (301-1) provided with several holes;

the structure is provided with a movable slot (270) to enable the bow (273) and the branch air tube (272) to move at a set swing angle, the sealing ring (295) is arranged at the axis of the swing and is made of flexible material like rubber etc to let the movement of the bow (273) and the air tube of right ear (272) flexible and the transmission of acoustic wave unobstructed;

the inner diameter of the small pipe (302) is much smaller than the inner diameter of the tee (290), the specific size is calculated and determined by the attenuation value of the branch air tube of right ear to let the sound volume of right and left ear keep the same;

the bottom of the tee (290) is provided with a mounting plate (297) with small holes, which is mounted at the left ear casing (276) by the screw (290-1) and has a positioning pin to accurately position the tee at the bottom of the left ear casing (276). The joint from the sound outlet of the big speaker (284) to the cover plate of the sound cavity of right ear and the cover plate of the sound cavity of left ear are all sealed, so that the acoustic waves would not be leaked, and the sounds played from the big speaker (284) are all sent to the left and right ears for listening.

an audio amplifier circuit can be set in the font of the big speaker if the volume is too low, the amplifier circuit is installed in the big speaker housing (286-A), and the value of the amplification power of the amplifier circuit is selected by the requirements;

set up a holonomic noise-reduction receiver conversion system: the first noise-reduction microphone drives the speaker (278) by the amplifier (282-A), the sound outlet of the speaker (278) is connected to the big end of the acoustic wave concentrator (278-B) of which the small end is connected to the small air tube (277-A), the small air tube (277-A) passes from the noise-reduction universal transmission arm (277) into the left ear casing (276) and then is connected to the hard connector (275) of which the other end is inserted into the one end of the small tube (289) of the combined air tube (283), the other end of the small tube (289) is connected to the curved hard tube (275-A) passing through the separator (285) and connected to the small end of the small acoustic wave concentrator (271) by a soft tube, the big end of the small acoustic wave concentrator (271) (sound amplifier) is connected to the sound receiving face of the second receiver (275-B) of which the conductor is connected to the answer line of the metal shielded wire (287) through the control of the switch (286) which can connect and disconnect the telephone receiving system to make people hear or cannot hear the user's speech, and then it is connected to the communication device by the connector (290), the battery of the converter is arranged in the converter housing (278-A) having the indicator light (281) which indicated the power on/off, the translucent body of the indicator light (281) is molded on the converter housing (278-A) provided with the switch (297-A) to control the power on/off, the switch is sealed by a rubber mat, a waterproof charging socket (282) is provided to charge the battery, a plug-in separator (278-C) and a slot plate (278-D) are arranged among the speaker (278), the amplifier circuit and the first microphone (280), a flexible material is placed inside the slot plate (278-D), the wire of the speaker passes through the separator and is sealed with glue, the converter housing (278-A) is fixed to the universal arm (277) with the screw (277-A) or by injection molding, the combined air tube is provided with one big tube and one small tube, which seems just one tube in appearance, not only beautiful but light;

The shell (286-A) is provided therein with a separator to separate the big speaker (284) and the second receiver (275-B), so as to prevent the big speaker (284) from interfering with the second receiver (275-B).

Embodiment 6

The noise-reduction microphone of the binaural over-ear noise-reduction air tube headphone with mono channel is a device converting an active audio signal into a passive transmission signal and restoring to the active audio signal again according to Embodiment 5.

The transmission way of the noise-reduction microphone is different from that in Embodiment 5, and the remaining structure is the same as that of the noise-reduction earphone in Embodiment 5.

The noise-reduction air tube microphone in the present Embodiment, as the structure of FIG. 34, a housing (278-C) is mounted at the end of the universal transmission arm (277-1), and the housing (278-C) is provided therein a megaphone (262-1) which includes the cover (261), the diaphragm (262), the acoustic wave concentrator (263), and the air tube (264), the small air tube (264) passes from the noise-reduction universal transmission arm (277-1) into the left ear casing (276-1) and then is connected to the hard connector (275-1) of which the other end is inserted into the one end of the small tube (289-1) of the combined air tube (283-1), the other end of the small tube (289-1) is connected to the curved hard tube (275-C) passing through the separator (285-1) and connected to the small taper-shape end (271-1)(sound amplifier) of the small microphone (275-D) by a soft tube, the big end of the small taper-shape end (271-1) is connected to the sound receiving face of the small microphone (275-D) of which the conductor is connected to the answer line of the metal shielded wire (287-1) through the control of the switch (286-1) which can connect and disconnect the telephone receiving system to make people hear or cannot hear the user's speech, and then it is connected to the communication device by the connector (290-1), and in this way, the passive audio signal is directly generated by the small microphone without conversion, the housing (278-C) near the above cover (261) has several holes, the circuits with joint all sealed are simpler and more cost-effective.

The shell (286-C) is provided therein with a separator (285-1) to separate the big speaker (284-1) and the small microphone (275-D), the conductor is glued after passing from the separator (285-1), so as to prevent the big speaker (284) from interfering with the second receiver (275-B).

An audio amplifier circuit can be arranged at the output terminal of the small microphone to amplified output audio signal if it is enough, the circuit shares the same electric power with the circuit of the big speaker or are installed at one circuit board, the power is supplied from the battery mounted on the housing or the battery line of the communication device;

The advantage of this structure is that all batteries keeps away from brain and ear, which achieves the great anti-radiation effects.

Embodiment 7

The noise-reduction earphone as mentioned above, the left and right speakers and the second microphone are mounted in the switch casing in this embodiment with the same connection ways embodiment 2. Three air tubes are bonded together covered by flexible material outside and its cross-section is triangle shape; other structures keep the same as embodiment 2.

Embodiment 8

The noise-reduction earphone as mentioned above, a noise-reduction aviation over-ear headphone in the present embodiment is provided with the structure including a stitched steel head bow (247), the head bow (247) and an adjustable bracket (251) fixed together by screws, the adjustable bracket (251) and a fixing bracket (252) are fixed together by self-locking nuts, the fixing bracket (252) is connected to a left ear casing (253) through lock pillars, the right ear casing (250) is connected and fixed in the symmetric and same way as the left ear casing (253).

The noise-reduction microphone (254-1) is mounted in the megaphone housing (254) connected to a universal hose (255) with a variable gear, the left ear and right ear sound cavity is disposed in the ear casing, the air tube (258) of the right sound cavity passes through the left ear casing and is connected to the sound cavity inside the right ear casing along a steel bow (247).

Embodiment 9

Figure 28:
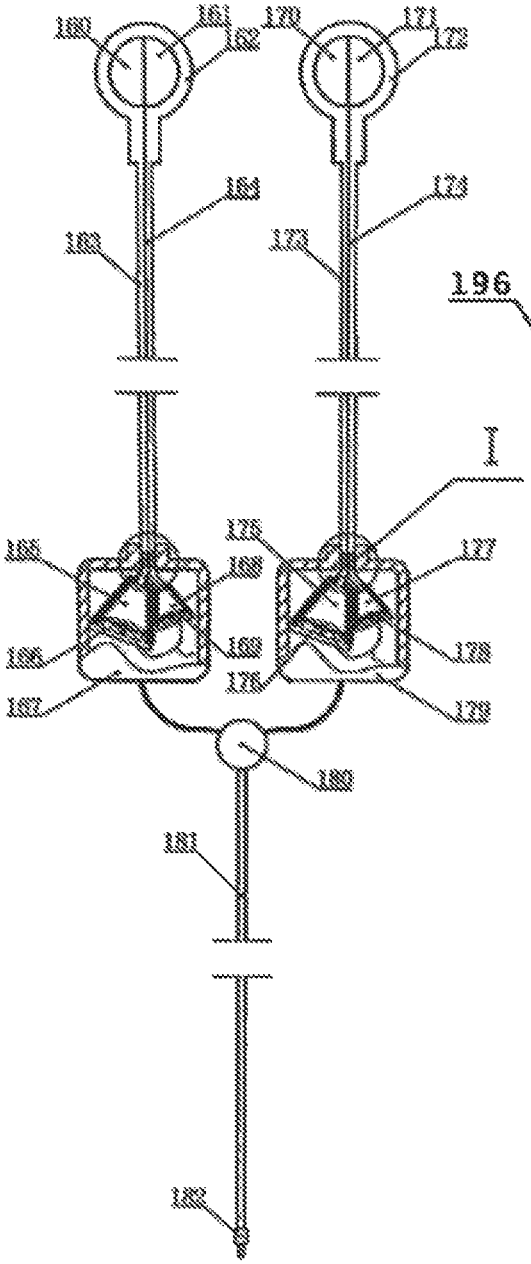
FIG. 28 is a schematic view of the stereo wired earphone, having two groups of two speakers with different frequency response connected to two sound chambers by two air tubes for two ears listening.
Figure 29:
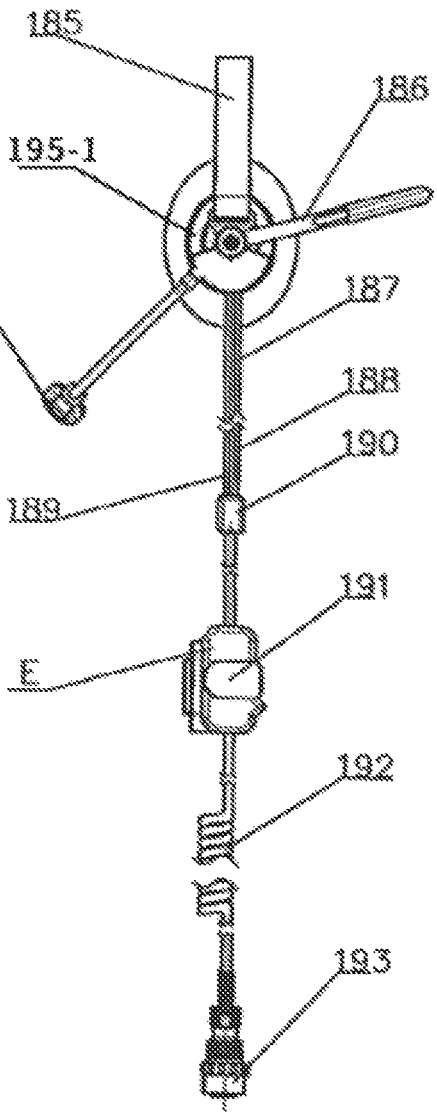
FIG. 29 is a side section view of the noise reduction safe over ear headphone.
Figure 30:
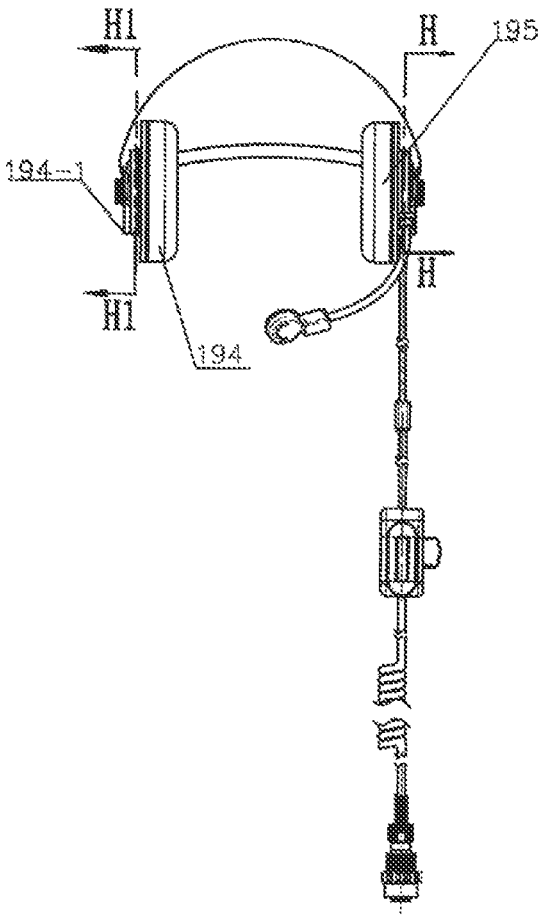
FIG. 30 is a front view of the noise reduction safe over ear headphone.
Figure 31:
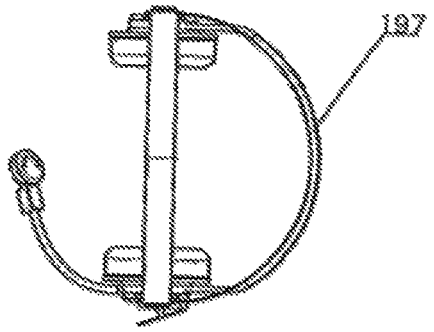
FIG. 31 is a top view of the noise reduction safe over ear headphone.

The noise-reduction earphone as mentioned above, separately provides with three speakers with different frequency response, three sound wave transmission channels with different response, sound cavities connected to the channels and conductors of sound wave transmission channels for one ear or two ear, the corresponding structure according to claim 24 is that the two earphones are separately provided with the moving iron speaker (166) (176) and the moving coil speaker (169) (178), each of them is separately disposed in big end of the acoustic wave concentrator (165) (175) and (178) (177), the acoustic wave concentrator (165) (175) and (178) (177) is separately configured to the one end of the air tube (163) (164) and (173) (174) of which the parallel end is separately connected to the sound cavity (160) (161) inside the earplug (162) and the sound cavity (170) (171) inside the earplug (172), adds one more pair of speakers, air tubes and sound chambers while setting the speaker with three different frequency response based on claim 24 (as FIG. 28), the structure and connection manner are the same as claim 24.

Embodiment 10

The noise-reduction earphone as mentioned above, is provided with several speakers with different frequency response for one ear or two ears is the noise-reduction earphone with high sound quality.

Embodiment 11

Figure 27:
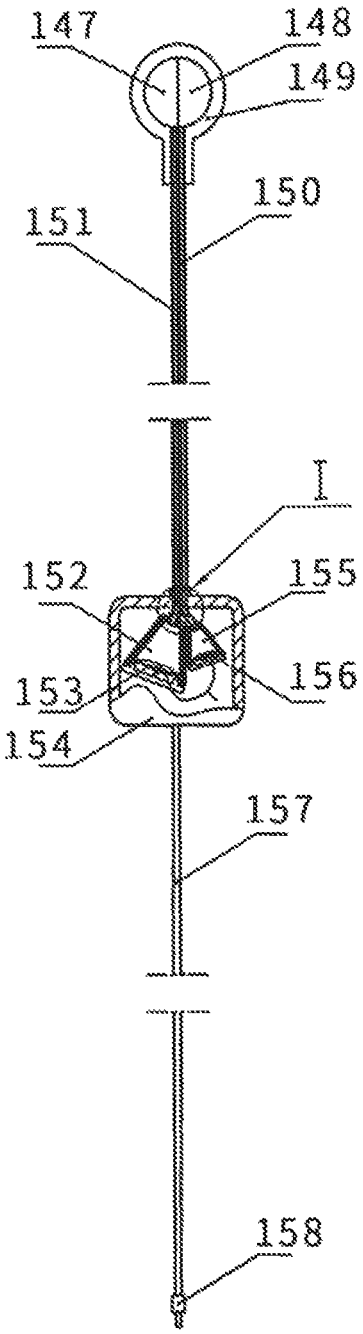
FIG. 27 is a schematic view of the wired earphone, having two speakers with different frequency response connected to two sound cavities by two air tubes for one ear listening.
Figures 1, 27:
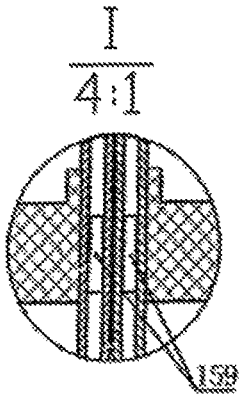
Figures 2, 27:
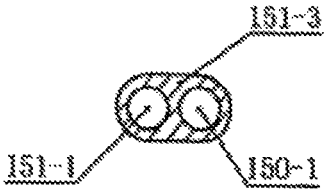
Figure 56:
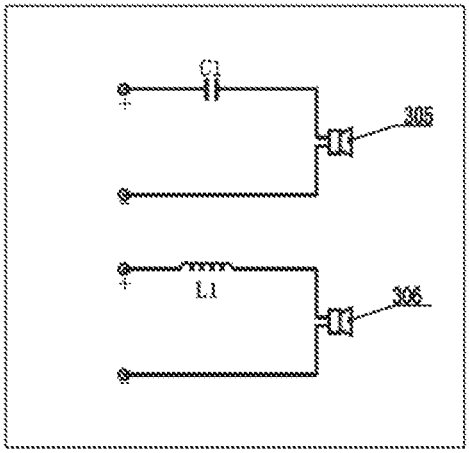
FIG. 56 is a schematic view of the circuits of high frequency speaker and low frequency speaker.

The first type of circuit with each one high frequency and one low frequency speaker in the present embodiment:

the noise-reduction wired headphone (FIG. 27) with high and low frequency speakers is provided with a frequency dividing circuit for the audio signal input pathway of the two speakers respectively, and a capacitance C1 is added to the high frequency speaker (305), and the capacity is 2.2 uF;

the inductance L1 is connected in series from the loop of the audio signal input terminal of the low frequency speaker (306), and the inductance value is 0.57 mH, the crossover point of the high and low frequency is set as 4500 HZ, referring to FIG. 56.

Embodiment 12

Figure 57:
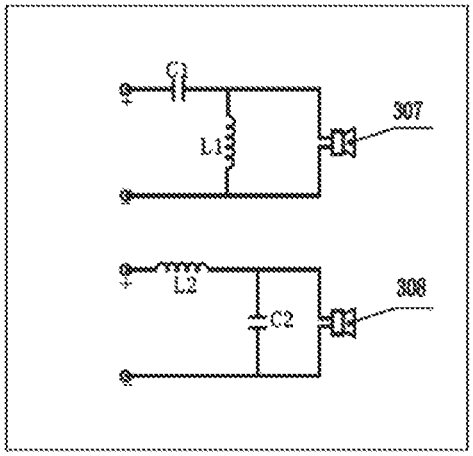
FIG. 57 is a schematic view of the circuits of high frequency speaker and low frequency speaker in other ways.

The second type of circuit with each one high frequency and one low frequency speaker in the present embodiment:

the input terminal of a high frequency speaker (309) of the binaural wired earphone (FIG. 28) is connected in series with a capacitor C1 with a capacitance of 1.1 uF and in parallel with an inductor L1 with an inductance of 1.31 mH, the output terminal of a low frequency speaker (308) is connected in series with an inductor L2 and in parallel with a capacitor C2 with a capacitance of 1.1 uF; referring to FIG. 57.

Embodiment 13

Figure 58:
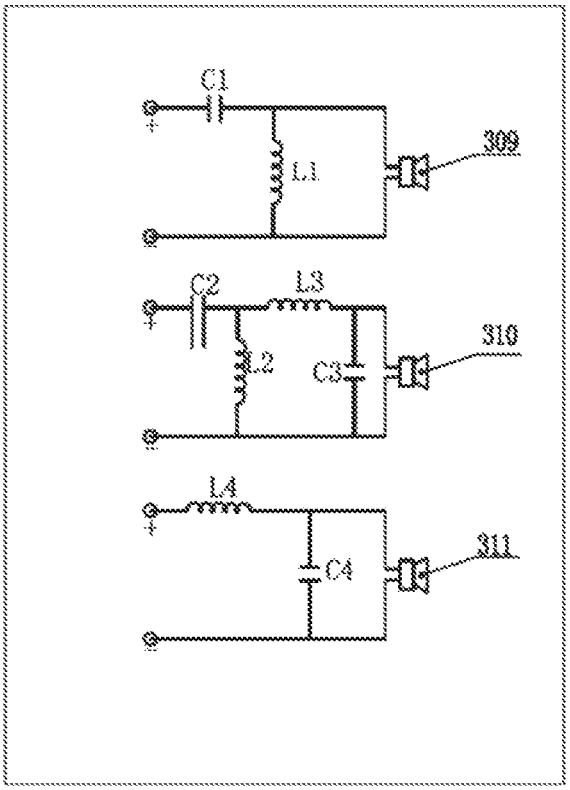
FIG. 58 is a schematic view of frequency division circuits of three speaker.
Figure 59:
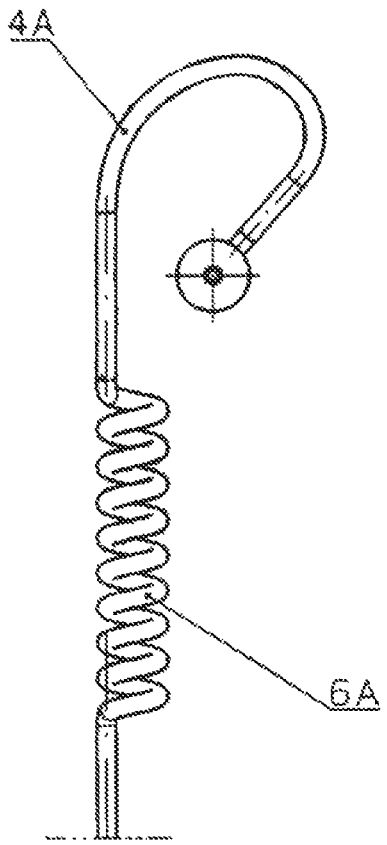
FIG. 59 is a front section view of the structure of the air tube or the conductor curvedly hooked on ears.
Figure 60:
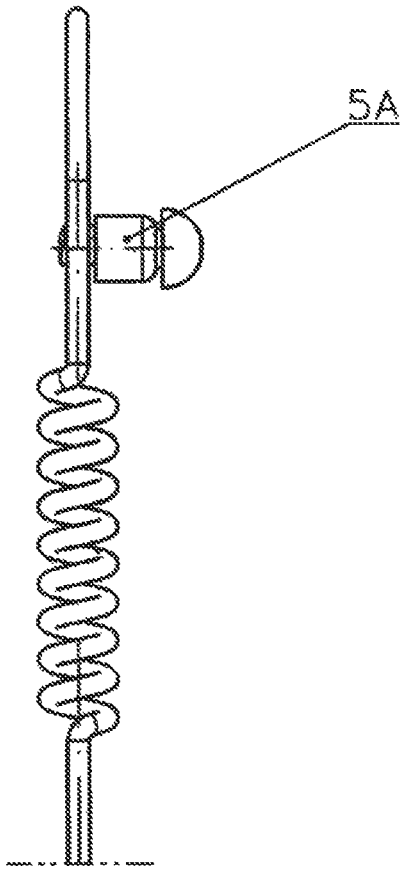
FIG. 60 is a side section view of the structure of the earplug curvedly hooked on ears by the air tube or the conductor.
Figure 61:
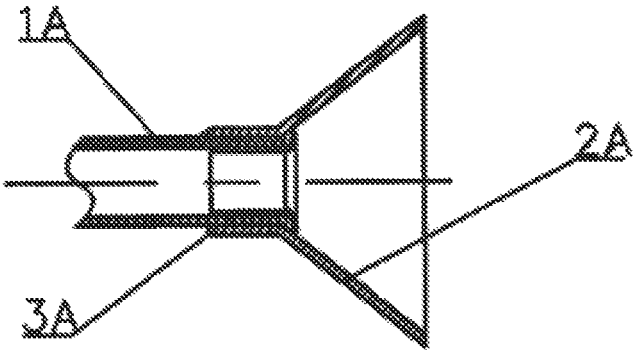
FIG. 61 is a schematic view of the air tube connected to the sound cavity by hollow rivets.

The third type of circuit with one high frequency, one medium frequency and one low frequency speaker in the present embodiment:

add one more set of speaker, air tube and sound cavity for each ear based on the structure of the wired earphone (FIG. 28), which means separately equips with three speakers with different frequency response, three sound wave transmission channels with different response, sound chambers connected to the channels and wires of sound wave transmission channels, the input terminal of a high frequency speaker (309) is in series with a capacitor having a capacity of 1 uF, and the circuit is in parallel with an inductor L1 with an inductance of 1.31 mH, the input terminal of a two divided-frequency medium speaker (310) is connected in series with a capacitor C1 with a capacitance of 11.06 uF and an inductor with a capacity of 1.02 mH in the back, connect an inductor L2 with a capacity of 11.32 mH to the one end of the speaker between the capacitor C2 and the inductor L3, connect a capacitor C3 in parallel at both ends of the speaker, the input terminal of three divided-frequency (311) is connected in series with an inductor L4 with a capacity of 11.32 mH and a capacitor C4 in parallel with a capacity of 11.06 uF; the crossover point of the low frequency is set as 450 HZ; the high frequency is set as 5000 HZ; referring to FIG. 58.

Figure 63:
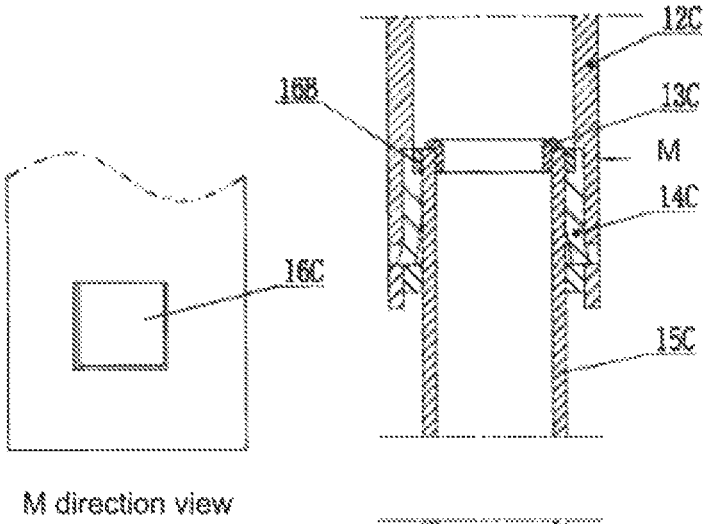
FIG. 63 is a direction view of buckled M.
Figure 62:
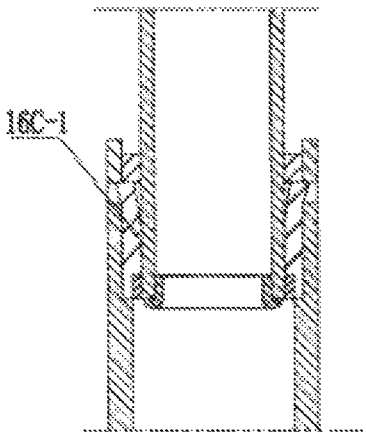
FIG. 62 is a schematic view of an air tube connected with an inverted buckle.
Figure 65:
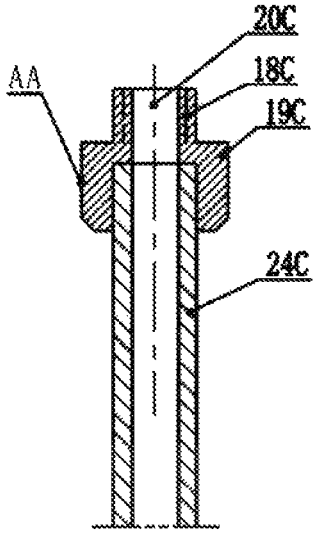
FIG. 65 is a view of the structure of the spiral movable connection head and its connection with air tube.
Figure 64:
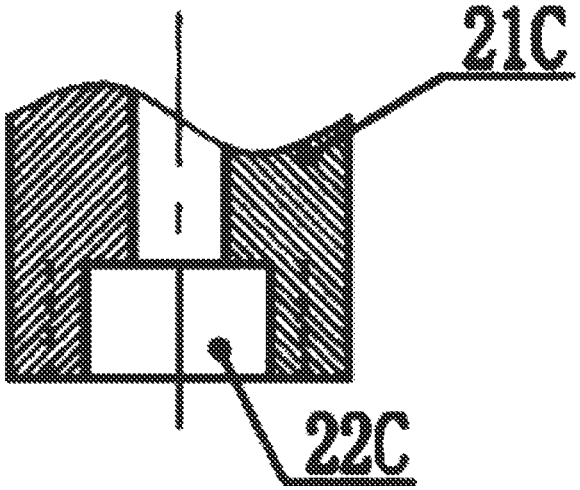
FIG. 64 is a schematic view of the structure of the earplug connected to a movable head.
Figure 66:
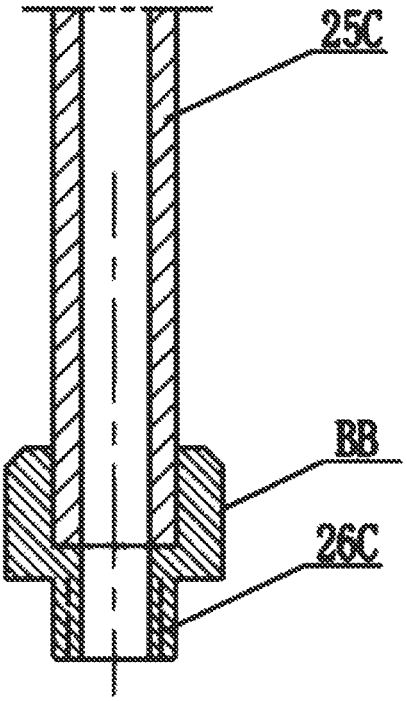
FIG. 66 is a structural diagram of two ends of the spiral movable connection head.
Figure 67:
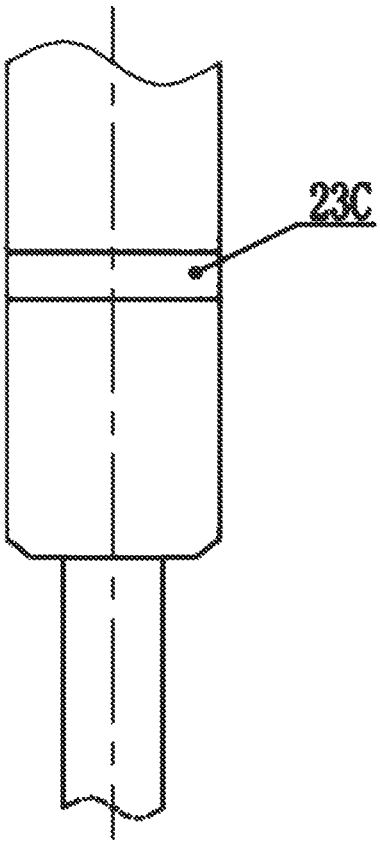
FIG. 67 is a schematic view of the assembled appearance of the spiral movable connection head and the earplug tube.

Embodiment 14 an air tube connection head in the present embodiment is arranged at the joint between the headphone head and the air tube, the structure is as following:

the connection head (14C) is provided with two left and right inverted buckles, the one end of an air tube covered with metal sleeve is inserted and riveted by a hollow rivet in the connection head (14C), another connection head (14C1) having the same structure as (14C) is also placed at the other end of the air tube, so that the air tube can be actively connected to the acoustic wave concentrator inside the speaker housing, as FIG. 62, FIG. 63 show, the active connection head at two ends of the air tube is symmetrical and interchangeable;

the earplug with such connection structure can be made into a large size, a medium size, a small size with purple color, which is interchangeable for users.

Embodiment 15

The joint between the earplug and air tube in the present embodiment is provided with an air tube active connection head of another structure;

(2) the active head (AA) of the spiral air tube, the one end is set as external thread (18C) of which the inner diameter of the inner hole (20C) is the inner diameter of the air tube, the diameter of the inner hole of the other end of the active head (AA) is set as the same as the outer diameter of the air tube, the air tube (24C) is glued when inserted into the hole, the outer diameter (19C) of the active head (AA) is the same as the overall dimension of (21C) connecting the earplug head and the air tube, the screw hole (22C) in the inner hole of the joint of earplug can be screwed down and interchanged with the external thread (180) of the active head (AA), the earplug is red, the other end of the air tube (24) is connected to another active head (BB) having the same structure as the active head (AA), an air tube is inserted and glued in the active head (25C), the screw thread (26C) and the screw hole on the speaker hosing is matching and interchangeable, puts a decorative ring at the joint between the active head (AA) and the earplug tube, puts a decorative ring at the joint between the active head (BB) and the speaker, the screw threads of the active head (AA) and the active head (BB) are the same, which are interchangeable with the screw hole (22C) of the earplug and the speaker;

Embodiment 16

A noise-reduction safe Bluetooth earphone provided with the noise-reduction air tube microphone as claims 1 is wherein the Bluetooth earphone is provided with an audio input jack forming a signal connection with the connector or the connector with adapter.

It should be noted that the above embodiments are provided for describing the present invention in detail, but not intended to limit the scope of the present invention. Without departing from the scope the present invention, those skilled in the art can make various improvements and modifications, within the scope as defined by the appended claims.

What is claimed is:

1. A noise-reduction air tube microphone, comprising:

an acoustic receiving device for receiving sound wave signals comprising:

an acoustic wave concentrator having a big end for receiving sound wave signals and a small end for concentrating the sound wave signals, a sound signal capture unit made by a piece of diaphragm, and a cover with a multiple of through-holes provided on outside of the diaphragm to tightly fasten the diaphragm on the big end of the acoustic wave concentrator;

a sound signal capture device for converting the sound wave signals to electronic signals comprising:

an acoustic wave amplifier with a big end and a small end, a small microphone provided at a big end of the acoustic wave amplifier, an amplifier connected with the small microphone;

a connecting device for connecting different devices:

an air tube, one end of the air tube is connected with the small end of the acoustic wave concentrator and other end of the air tube is connected with the small end of the acoustic wave amplifier, a conductor, one end of the conductor is connected with the small microphone and other end of the conductor is connected with the amplifier, and a metal shield wire is connected with the amplifier; and the sound wave signals received by the big end of the acoustic wave concentrator, then concentrated by the small end of the acoustic wave concentrator, then passed through the air tube, then changed from acoustic wave signals to electronic signals by the microphone, then amplified by the amplifier, then amplified electronic signals are outputted through the metal shield wire.

2. The noise-reduction air tube microphone according to claim 1, wherein all connecting joints are completely sealed, which forms a megaphone.

3. The noise-reduction air tube microphone according to claim 1, wherein the acoustic wave amplifier is a taper-shaped sound amplifier.

* * * * *